US009033447B2

(12) United States Patent
Morita et al.

(10) Patent No.: US 9,033,447 B2
(45) Date of Patent: May 19, 2015

(54) METHOD AND APPARATUS FOR PRINTING ON TABLETS

(75) Inventors: Tadao Morita, Kyoto (JP); Shigeki Tasaka, Kyoto (JP); Manabu Yamashita, Kyoto (JP); Seiya Matsumoto, Kyoto (JP); Keisuke Noda, Kyoto (JP); Yuta Imai, Kyoto (JP)

(73) Assignee: Kyoto Seisakusho Co., Ltd., Kyoto-shi (JP)

( * ) Notice: Subject to any disclaimer, the term of this patent is extended or adjusted under 35 U.S.C. 154(b) by 0 days.

(21) Appl. No.: 14/114,950

(22) PCT Filed: May 23, 2012

(86) PCT No.: PCT/JP2012/063834

§ 371 (c)(1),
(2), (4) Date: Oct. 31, 2013

(87) PCT Pub. No.: WO2012/169391

PCT Pub. Date: Dec. 13, 2012

(65) Prior Publication Data

US 2014/0168309 A1 Jun. 19, 2014

(30) Foreign Application Priority Data

Jun. 9, 2011 (JP) ..... 2011-128925
Apr. 12, 2012 (JP) ..... 2012-090740

(51) Int. Cl.
*B41J 29/38* (2006.01)
*B41J 3/407* (2006.01)
*B41J 11/42* (2006.01)

(52) U.S. Cl.
CPC . *B41J 3/407* (2013.01); *B41J 11/42* (2013.01)

(58) Field of Classification Search
None
See application file for complete search history.

(56) References Cited

U.S. PATENT DOCUMENTS 6,741,731 B1 * 5/2004 Yamamoto et al. ..... 382/141
2004/0091594 A1 * 5/2004 Ackley et al. ..... 426/383

(Continued)

FOREIGN PATENT DOCUMENTS

JP 1990-27239 1/1990
JP 1991-148430 6/1991

(Continued)

OTHER PUBLICATIONS

Japan Patent Office, Office Action in counterpart Japanese Patent Application, issued Sep. 4, 2014, 2 pages (partial English translation).

(Continued)

*Primary Examiner* — Geoffrey Mruk
*Assistant Examiner* — Bradley Thies
(74) *Attorney, Agent, or Firm* — W. F. Fasse

(57) ABSTRACT

A method and apparatus are for contactless-printing on tablets that are supplied successively at random spacings in the conveyance direction, respectively in plural rows. The apparatus includes a hopper to supply tablets, a distributing unit to distribute the supplied tablets in plural rows, a conveyor to convey the tablets randomly with the random spacings in the conveyance direction and with the rows maintained, a detection camera to detect the tablets during conveyance, an inkjet printer to print on the tablets based on data detected by the detection camera, an inspection camera to check a printing state on the tablets, and a defective tablet rejection unit to reject a defective tablet during conveyance of the tablets based on the check result of the inspection camera.

20 Claims, 34 Drawing Sheets

(56) References Cited

U.S. PATENT DOCUMENTS

| | | | | |
|---|---|---|---|---|
| 2006/0222702 | A1 | 10/2006 | Barreto et al. | |
| 2007/0194034 | A1* | 8/2007 | Vasiadis | 221/21 |
| 2011/0088810 | A1* | 4/2011 | Cicognani | 141/192 |
| 2011/0128557 | A1 | 6/2011 | Kinoshita et al. | |

FOREIGN PATENT DOCUMENTS

| | | | |
|---|---|---|---|
| JP | 07-206144 | A | 8/1995 |
| JP | 2008-200234 | | 9/2008 |
| JP | 2008-279060 | | 11/2008 |
| JP | 2011-020325 | A | 2/2011 |
| WO | 2009/025371 | | 2/2009 |

OTHER PUBLICATIONS

PCT Examiner Felipe Rubio Hide, Partial International Search Report of the International Searching Authority for International Application PCT/JP2012/063834, mailed Oct. 1, 2012, 3 pages, European Patent Office, HV Rijswijk, Netherlands.

Abridged English translation of the Second Japanese Office Action issued on Nov. 14, 2014 by Japan Patent Office in Japanese Priority Application, 2 pages.

* cited by examiner

METHOD AND APPARATUS FOR PRINTING ON TABLETS

TECHNICAL FIELD

The present invention relates to a method and apparatus for printing on tablets that are supplied successively and randomly, and more particularly to a method and apparatus for contactless-printing on a large number of tablets that are supplied in a predetermined plurality of rows of tablets.

BACKGROUND ART

Recently, in medical fields, identification codes designating company names and/or product names have been added to front faces of tablets in order to prevent medical accidents such as mis-preparation of medicines by pharmacists and taking medicines erroneously by patients. Conventionally, addition of identification codes to tablets was carried out by means of stamping, transcription, or the like.

Stamping is a method for imprinting on a surface of a tablet by compressive forming with a carved punch when forming powder or granule into the tablet by a tablet press. Such a stamping is mainly used for uncoated tablets and film-coated tablets. However, in the event that the punch does not leave the tablet smoothly due to pharmaceutical formulation and powder or granule properties when the punch presses against the surface of the tablet in compressive forming, a part of imprint is sometimes left out and thus stamping could not imprint a complicated shape clearly. Also, in the case of film-coated tablets, since the tablets are coated after imprinting, imprints tend to be blurred and thus readability was poor.

On the other hand, transcription is a printing method for pressing a surface of a tablet with a transfer roller. According to transcription, in the case of a film-coated tablet with a smooth coated surface and a sugar-coated tablet with a sugar coating, clear print is available. However, in the case of a film-coated tablet with an unsmooth coated surface, printing tends to be smeared and blurred, and in the case of an uncoated tablet, a printing failure sometimes occurs because the uncoated tablet has properties of absorbing ink and there is powder attached on a surface of the uncoated tablet. Also, tablets need to be positioned one by one in a pocket of a printing apparatus, and thus clogging of the pocket often occurs. Further, in the case of an R tablet with a round surface, since the transfer roller contacts a limited area of the round surface of the R tablet and printing thus needs to be carried out in a small area, the size of printed letters becomes small and readability was poor.

Accordingly, in a contact printing style such as a prior-art tablet press or transcription-style printing apparatus in which a punch or transfer roller is pressed against a tablet, imprinting failures or printing failures occurred, thus making yield rate of products worse, which became a factor of deteriorating the quality of the products. Also, each time an identification code changes an expensive punch or transfer roller needs to be changed, thus increasing cost. Therefore, there was a strong demand for a contactless-printing that can contactless-print on tablets without causing damages on the tablets and that can also change identification codes inexpensively and easily.

On the other hand, as a contactless printing style, laser printing on tablets is known in the art. However, for laser printing, if tablets do not contain titanium oxide, color of a printing portion cannot appear. In the case of a film-coated tablet or sugar-coated tablet, it contains titanium oxide on a surface thereof and thus color of print can appear, but in the case of an uncoated tablet, it does not contain titanium oxide and thus it was difficult to indicate color of print by laser printing.

Accordingly, the applicant of the present application proposed a printing apparatus that can contactless-print on a work-piece (or tablet) by a method other than a laser printing (see paras. [0035] to [0038] and FIGS. 1, 2, 4 of Japanese patent application publication No. 2011-20325).

This printing apparatus is comprised of a supplying unit to supply works (or tablets) successively, a conveyor to randomly convey the works supplied by the supplying unit, a CCD camera to detect and photograph the works introduced in a predetermined area, and an inkjet printer to print on the works during conveyance of the conveyor based on work information by the CCD camera.

In this case, since print process is carried out by injection of ink on a surface of the work by the inkjet printer, contactless-printing on the tablet can be achieved. As a result, not only for film-coated tablets and sugar-coated tablets but also for uncoated tablets, clear printing is available. Also, in this case, printing failures resulting from contact with a tablet do not occur, thus improving yield rate of the products. Further, since it can readily react to changes of identification codes including variable information such as expiration date, manufacturing number, and the like, thus reducing cost.

Moreover, even in the event that positions, orientations and faces of supplied tablets are not equal but random, print process of the tablets is carried out by detecting the positions, orientations and faces of the tablets based on images captured by the CCD camera, thus eliminating the necessity for positioning the tablets one by one and allowing for a plurality of tablets to be processed all together. Thereby, printing can be efficiently processed and high speed process is available.

In the printing apparatus mentioned above, when it detects a defective tablet (also sometimes called simply "a defective" herein) after the printing process and rejects the defective, the defective needs to be picked up with pinpoint accuracy among a large number of tablets disposed randomly on the conveyors. However, in the above-mentioned printing apparatus, since a large number of tablets supplied are disposed at a random spacing on the conveyors not only in a longitudinal conveyance direction but also in a lateral width direction perpendicular to the longitudinal conveyance direction, it is difficult to reject only the defective tablet with pinpoint accuracy.

The present invention has been made in view of such conventional circumstances and the problem which the present invention aims to resolve is to provide a tablet printing apparatus that can contactless-print on tablets supplied successively and randomly and that can reject only defective tablets securely with pinpoint accuracy.

DISCLOSURE OF INVENTION

A tablet printing apparatus for printing on tablets according to a first aspect of the invention comprises a tablet supplying unit to supply a large number of tablets; a distributing unit to distribute supplied tablets in a predetermined plurality of rows; a tablet conveying unit to convey distributed tablets randomly in the predetermined plurality of rows; a tablet detecting unit to detect the tablets during conveyance of the tablet conveying unit; a contactless-printing unit to print on the tablets during conveyance based on data detected by the tablet detecting unit; a tablet inspection unit to check printing state on the tablets; and a defective tablet rejection unit to reject a defective tablet during conveyance in the plurality of rows, wherein the defective tablet has printing failures based on the check result of the tablet inspection unit.

According to the above aspect, since the contactless-printing unit prints on a large number of tablets contactlessly that are conveyed successively and randomly by the tablet conveying unit, clear print can be achieved regardless of dosage forms and shapes of the tablets. Also, since printing process is conducted based on data detected by the tablet detecting unit, it can also readily react to tablets whose positions and orientations are random.

Moreover, a large number of tablets supplied by the tablet supplying unit are distributed to a predetermined plurality of rows of tablets by the distributing unit, and the distributed tablets are conveyed randomly with the plurality of rows maintained by the tablet conveying unit. Thereby, during conveyance of the tablets, each of intervals between longitudinally adjacent tablets in a conveyance direction is random, but each of intervals between the laterally adjacent tablets in a traversal direction perpendicular to the conveyance direction is maintained at a constant value. As a result, for a defective tablet as well, an interval between the defective tablet and its laterally adjacent tablet in a traversal direction is maintained at a constant value. Consequently, when rejecting a defective tablet detected by the tablet inspection unit, the defective rejection unit can separate the defective tablet easily from other tablets adjacent to the defective tablet in the traversal direction perpendicular to the conveyance direction and can reject only the defective tablet securely from other tablets with pinpoint accuracy.

In a second aspect of the invention, the distributing unit includes a central dispersion part having an inverted V-shape in cross section and located centrally in a width direction of the distributing unit, and a plurality of distributing parts each having an inverted V-shape in cross section and located on opposite sides of the central dispersion part. The central dispersion part has a pair of inclined surfaces to form the inverted V-shape extending in a direction of conveyance of the tablets to disperse the tablets on opposite sides of the central dispersion unit. Each of the distributing parts has a pair of inclined surfaces of an asymmetrical shape extending in the direction of conveyance of the tablets to distribute the tablets in the plurality of rows. Each of the inclined surfaces of the distributing part is formed of a first inclined surface extending upright and located at a position close to the central dispersion part, and a second inclined surface extending diagonally and located away from the central dispersion part. Here, "located centrally in a width direction of the distributing unit" means not only a precisely central position in the width direction but also a position in the vicinity of the precisely central position in the width direction. Because the number of the distributing parts may be provided equally on opposite sides of the central dispersion part and in the alternative, the number of the distributing parts may be different on opposite sides of the central dispersion part, e.g. two on one side and three on the other side of the central dispersion part.

According to the second aspect of the invention, a large number of tablets supplied by the tablet supplying unit are introduced into the central dispersion part of the distributing unit to be dispersed equally (or substantially equally) on opposite sides of the central dispersion part, and then the tablets are thus introduced into the distributing parts on opposite sides of the central dispersion part. As the tablets introduced into the distributing parts travel through the distributing parts, the tablets maintain their inclined state on the second inclined surfaces of the distributing parts. Thereby, the tablets are distributed to a plurality of rows without overlapping each other.

In a third aspect of the invention, respective heights of the first and second inclined surfaces of each of the distributing parts become gradually greater from a side closer to the central dispersion part as the first and second inclined surfaces progress downstream along the direction of conveyance of the tablet conveying unit.

According to the third aspect of the invention, even in the event that the tablets are overlapped with each other on the inclined surfaces, since a tablet on an upper side will slip off a tablet on a lower side to move onto an adjacent inclined surface as the tablets travel downstream along the direction of conveyance, respective tablets can be securely separated from each other and distributed to respective inclined surfaces without overlapping each other.

In a fourth aspect of the invention, the tablet conveying unit is formed of a plurality of conveying parts, the tablets being suction-held on the corresponding conveying parts during conveyance. As in a fifth aspect of the invention, a plurality of conveying parts may be formed of a plurality of belts that are spaced side by side, the tablets during conveyance being suction-held at spaces between the adjacent belts. As in a sixth aspect of the invention, a plurality of conveying parts may be structured by forming a plurality of rows of suction holes on a belt, the tablets during conveyance being suction-held at the corresponding row of suction holes.

In those cases, respective tablets can be prevented from being slipped off or slipped out of place on the conveying parts, thereby causing transfer of the tablets from the distributing unit to the tablet conveying unit to be conducted smoothly to move the tablets at high speed.

In a seventh aspect of the invention, the tablet detecting unit and the tablet inspection unit are formed of image capturing means. The image capturing means have at least image sensors. More specifically, area sensor cameras, line sensor cameras, or the like may be used as the image capturing means. Especially, for the line sensor cameras, a high-speed image capturing is available and a conveyance rate can be increased compared to the area sensor cameras (e.g. CCD camera). Also, unlike the area sensor cameras, the line sensor cameras can capture successive images and thus address data of rotary encoders of the tablet conveying unit and detected data of the line sensor can be combined. At this juncture, because conveyance positions of the tablets and the captured image data are always coincided with each other, printing on the tablets can be conducted precisely.

In an eighth aspect of the invention, the tablet detecting unit has detection data including not only positions but also orientations of the tablets. In a ninth aspect of the invention, the tablet detecting unit has detection data further including heads or tails of the tablets.

In those cases, in the event such as that the tablets have secant lines, printing along a secant line and printing on a surface with/without a secant line can be available.

In a tenth aspect of the invention, the contactless-printing unit is constructed from an inkjet printer, the inkjet printer including a translatable inkjet head. Thereby, the inkjet head can be transferred to a maintenance position apart from a printing position.

In an eleventh aspect of the invention, the inkjet head includes a plurality of nozzles for discharging ink, and before a print process starts the inkjet head is controlled such that nozzles different from those used in a prior print process are used. Thereby, clogging of a dried nozzle that has not been used for a long time can be prevented.

In a twelfth aspect of the invention, the defective rejection unit is disposed above the tablet conveying unit and has a plurality of apertures each corresponding to each of the rows of tablets conveyed by the tablet conveying unit, defectives (i.e. defective tablets) being rejected from the corresponding apertures of the defective rejection unit. Thereby, the defectives can be securely rejected with pinpoint accuracy.

In a thirteenth aspect of the invention, the defective rejection unit suctions defectives from the apertures.

In a fourteenth aspect of the invention, the tablet conveying unit is formed of a first conveying unit that is disposed on an upper side of the tablet conveying unit and that conveys the tablets in a first direction, and a second conveying unit that is disposed below the first conveying unit and that conveys the tablets in a second direction opposite the first direction, and there is provided a reversing unit between a downstream end of the first conveying unit and an upstream end of the second conveying unit for reversing a front side and a back side of each of the tablets by holding and rotating the tablets on the first conveying unit. Thereby, the tablets on the first conveying unit are reversed by the reversing unit to be introduced onto the second conveying unit. As a result, back side surfaces of the tablets can also be examined and printed during conveyance of the second conveying unit.

In a fifteenth aspect of the invention, the reversing unit suctions the tablets during reverse of the tablets and releases the tablets after reverse of the tablets such that the tablets on the first conveying unit are reversed and delivered to the second conveying unit. Thereby, the tablets during reverse can be prevented from being slipped off or slipped out of place on the reversing unit and thus transfer of the tablets from the reversing unit to the second conveying unit can be carried out smoothly.

In a sixteenth aspect of the invention, there is an adjustable gap formed between the reversing unit and the second conveying unit. Thereby, tablets of different thickness can also be processed.

In a seventeenth aspect of the invention, the tablet printing apparatus further comprises a second tablet detecting unit to detect tablets during conveyance of the second conveying unit; a second contactless-printing unit to print on the tablets during conveyance based on data detected by the second tablet detecting unit; and a second tablet inspection unit to check printing state on the tablets by the second contactless-printing unit. Also, a defective rejection unit is disposed on a downstream side of the second tablet inspection unit, and the defective rejection unit is so constructed as to reject a defective (i.e. a defective tablet) including a printing failure based on the check result of the first tablet inspection unit and the second tablet inspection unit.

According to the seventeenth aspect of the invention, the tablets introduced onto the second conveying unit by the reversing unit are printed contactlessly by the second contactless-printing unit during conveyance of the second conveying unit. Thereby, backside surfaces of the tablets as well can be printed contactlessly. Also, since printing on the backside surfaces of the tablets can be conducted based on data detected by the second tablet detection unit, even in the event that the tablets on the second conveying unit are randomly located or oriented, printing on the tablets can be conducted with ease.

Moreover, since the tablets maintain a predetermined plurality of rows from the first conveying unit through the reversing unit to the second conveying unit, an interval between the adjacent tablets on the second conveyor is random in a longitudinal conveyance direction but maintained equally in a lateral width direction perpendicular to the longitudinal conveyance direction. Therefore, for defective tablets as well, a lateral interval between a defective tablet and an adjacent tablet in the lateral width direction perpendicular to the longitudinal conveyance direction is constant. As a result of this, when rejecting defectives that are detected by the first/second tablet inspection units, the defective rejection unit can separate the defectives easily from adjacent other tablets in the lateral width direction perpendicular to the longitudinal conveyance direction and can reject only the defectives securely with pinpoint accuracy.

A method for printing on tablets according to an eighteenth aspect of the invention comprises: a distributing process for distributing a large number of tablets in a predetermined plurality of rows; a conveying process for conveying the tablets, which have been distributed in the distributing process, randomly in the predetermined plurality of rows; a detecting process for detecting the tablets during conveyance in the conveying process; a printing process for contactless-printing on the tablets during conveyance based on data detected in the detecting process; an inspection process for checking printing state on the tablets; and a defective rejection process for rejecting a defective (i.e. a defective tablet) during conveyance in the plurality of rows of the tablets, the defective including printing failures based on a check result in the inspection process.

According to the eighteenth aspect of the invention, since contactless-printing is carried out on a large number of tablets that are conveyed successively and randomly in the tablet conveying process, clear print can be achieved regardless of dosage forms and shapes of the tablets. Also, since the printing process is conducted based on data detected in the tablet detecting process, it can readily react to the tablets whose positions and orientations are random.

Moreover, a large number of supplied tablets are distributed to a predetermined plurality of rows in the distributing process, and the distributed tablets are conveyed randomly with the plurality of rows maintained in the tablet conveying process. Thereby, during conveyance of the tablets, each interval between longitudinally adjacent tablets in a longitudinal conveyance direction is random, but each interval between laterally adjacent tablets in a lateral direction perpendicular to the longitudinal conveyance direction is maintained at a constant value. As a result of this, for a defective tablet as well, an interval between the defective tablet and its laterally adjacent tablet in a traversal direction is maintained at a constant value. Consequently, when rejecting a defective tablet detected in the tablet inspection process, the defective tablet can be easily separated from other tablets adjacent to the defective tablet in the traversal direction perpendicular to the conveyance direction and only the defective tablet can thus be rejected securely with pinpoint accuracy.

In a nineteenth aspect of the invention, the detection data in the detecting process may include positions and orientations of the tablets.

Consequently, according to the tablet printing apparatus/method of the present invention, since a large number of tablets, which are conveyed successively and randomly by the conveying unit (or in the conveying process), are printed contactlessly by the contactless-printing unit (or in the contactless-printing process), clear print can be achieved regardless of dosage forms and shapes of the tablets. Also, since the printing process is conducted based on data detected by the tablet detecting unit (or in the tablet detecting process), it can readily react to the tablets whose positions and orientations are random. Moreover, because a large number of supplied tablets are distributed to a predetermined plurality of rows by the distributing unit (or in the distributing process) and the distributed tablets are conveyed randomly with the plurality of rows maintained by the tablet conveying unit (or in the tablet conveying process), an interval between a defective tablet and its laterally adjacent tablets in a traversal direction can be maintained at a constant value. Thereby, when rejecting a defective tablet, it can be easily separated from other tablets and only the defective tablet can be rejected securely with pinpoint accuracy.

BEST MODE FOR CARRYING OUT THE INVENTION

A method and apparatus for printing on tablets according to an embodiment of the present invention will be described hereinafter in accordance with the appended drawings.

First, we will explain an overall structure of a tablet printing apparatus and we will then explain primary component parts constituting the tablet printing apparatus individually in detail.

<Overall Structure>

Figure 1:
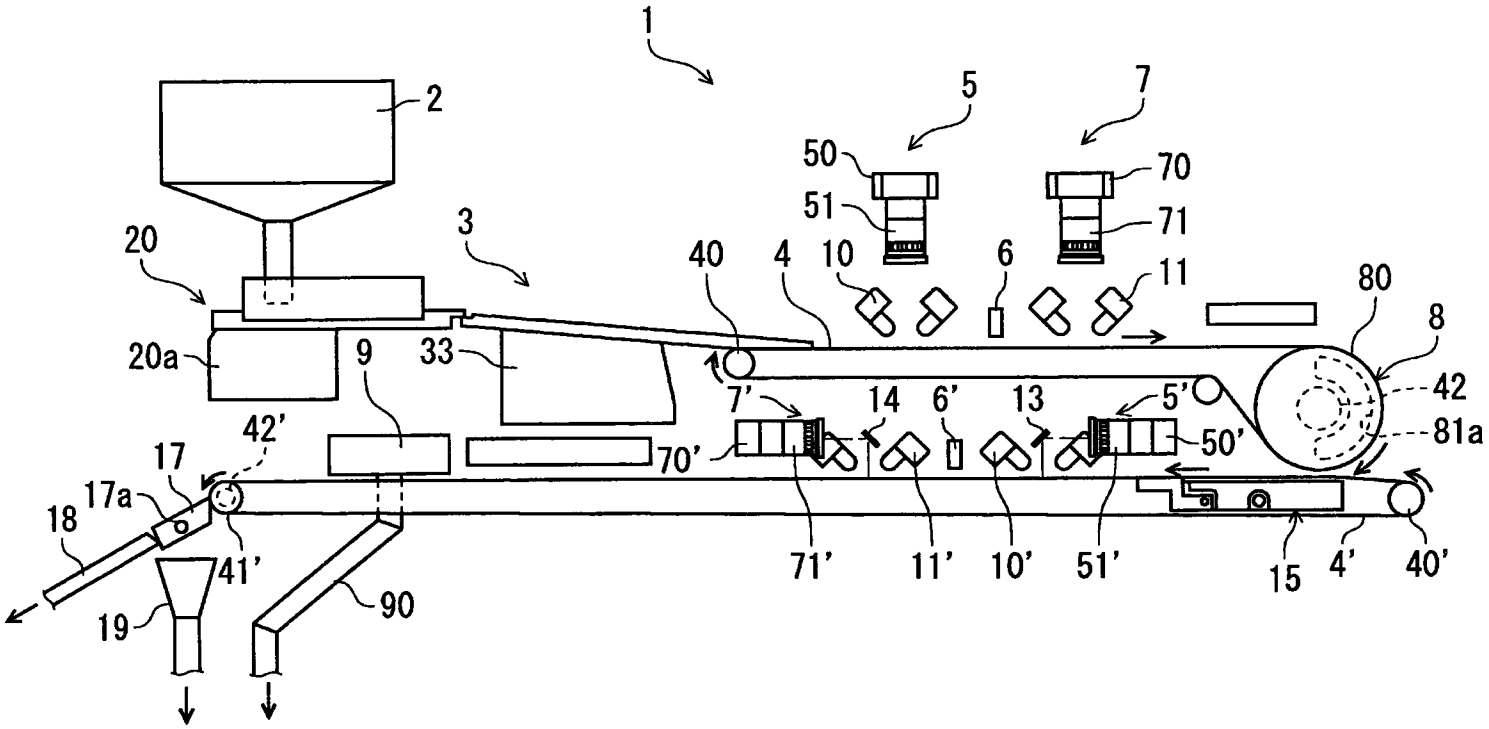
FIG. 1 is a schematic structural diagram of a tablet printing apparatus according to an embodiment of the present invention.

FIG. 1 shows a schematic structural diagram of a tablet printing apparatus according to an embodiment of the present invention.

As shown in FIG. 1, the tablet printing apparatus 1 includes a hopper 2 to supply a large number of tablets, a distributing unit 3 to distribute the tablets from the hopper 2 to a predetermined plurality of rows of tablets, a first conveyor 4 to convey the tablets from the distributing unit 3 randomly in an arrow marked first direction with the predetermined plurality of rows of tablets maintained, a first detection line sensor camera 5 to detect the tablets during conveyance of the first conveyor 4, a first inkjet printer 6 to print on the tablets during conveyance based on data detected by the first detection line sensor camera 5, and a first inspection line sensor camera 7 to examine print state on the tablets.

Also, the tablet printing apparatus 1 further includes a reversing unit 8 that is disposed at a downstream end of the first conveyor 4 and that has a reversing roller 80 to reverse heads or tails of the tablets on the first conveyor 4, a second conveyor 4' that is disposed below the first conveyor 4 and that conveys the reversed tablets randomly in a plurality of rows of tablets in an arrow marked second direction opposite the first direction, a second detection line sensor camera 5' to detect the tablets during conveyance of the second conveyor 4', a second inkjet printer 6' to print on the tablets during conveyance based on data detected by the second detection line sensor camera 5', a second inspection line sensor camera 7' to examine print state on the tablets, and a defective rejection unit 9 that is disposed on a downstream side of the second conveyor 4' and that suctions and rejects defectives including printing failures based on the result of examinations of the first and second inspection line sensor cameras 7, 7' during conveyance in a plurality of rows of tablets.

A print process by the tablet printing apparatus 1 is applied to tablets of any dosage form including uncoated tablets, film coated (FC) tablets, and sugar-coated tablets, and also applied to tablets of any shapes including flat tablets and R tablets.

As shown in FIG. 1, between the hopper 2 and the distributing unit 3, there is provided a vibration feeder 20 with a vibrator 20*a* to feed the supplied tablets to the distributing unit 3. The distributing unit 3 is declined downwardly as it goes forward and also has a vibration feeder 33. The first conveyor 4 is wrapped around a timing pulley 40 at an upstream end thereof and also wrapped around a reversing roller 80 in the form of a timing pulley at a downstream end of the first conveyor 4. As described hereinafter, the first conveyor 4 is formed of a plurality of endless timing belts that are spaced side by side in a direction perpendicular to a conveyance direction.

The first detection line sensor camera 5 has a line sensor 50 and a camera lens 51. Similarly, the first inspection line sensor camera 7 has a line sensor 70 and a camera lens 71. Below the first detection line sensor camera 5, a pair of lighting units (e.g. LED lighting units) 10 are provided to shine light on the tablets on the first conveyor 4. Similarly, below the first inspection line sensor camera 7, a pair of lighting units (e.g. LED lighting units) 11 are provided to shine light on the tablets on the first conveyor 4.

The reversing unit 8 has a suction chamber 81 formed therein to suction tablets on the first conveyor 4. At a drive shaft of the reversing unit 8, a rotary encoder 42 is fitted to detect a rotational position of the reversing roller 80 of the reversing unit 8 to detect a travel position of the first conveyor 4.

The second conveyor 4' is wrapped around a timing pulley 40' at an upstream end thereof and also wrapped around a timing pulley 41' at a downstream end thereof. As with the first conveyor 4, the second conveyor 4' is formed of a plurality of endless timing belts that are spaced side by side in a direction perpendicular to a conveyance direction and the tablets on the second conveyor 4' during conveyance are suction-held on spaces between the adjacent belts by suctioning air through the spaces. At a rotational shaft of the timing pulley 41', a rotary encoder 42' is fitted to detect a rotational position of the timing pulley 41' to detect a travel position of the second conveyor 4'.

Below the reversing roller 80 of the reversing unit 8 on an upstream side of the second conveyor 4', there is provided a height adjusting unit 15 to adjust a gap between the second conveyor 4' and the reversing roller 80. The height adjusting unit 15 is adapted to provide a smooth transfer of the tablets from the reversing roller 80 to the second conveyor 4' in the event that thicknesses of the tablets are altered.

The second detection line sensor camera 5' has a line sensor 50' and a camera lens 51'. Similarly, the second inspection line sensor camera 7' has a line sensor 70' and a camera lens 71'. In this exemplification, both of the cameras 5', 7' are disposed sideways and images of the tablets on the second conveyor 4' are captured by the cameras 5', 7' through mirrors 13, 14 that are deployed in front of the camera lenses 51', 71'. In the vicinity of the mirror 13, a pair of lighting units (e.g. LED lighting units) 10' are provided to shine light on the tablets on the second conveyor 4'. Similarly, in the vicinity of the mirror 14, a pair of lighting units (e.g. LED lighting units) 11' are provided to shine light on the tablets on the second conveyor 4'.

The defective rejection unit 9 has a downwardly extending chute or shoot 90 connected thereto. Defectives (i.e. defective tablets) that have been suctioned by the defective rejection unit 9 are rejected through the shoot 90 into a defective box (not shown) below the shoot 90. The downstream end of the second conveyor 4' has a chute or shoot 18 connected thereto through an openable and closable defective rejection damper 17. The defective rejection damper 17 is pivotable around a support shaft 17*a*. In the event that the defective rejection unit 9 has failed to reject a defective due to mis-suction, the defective rejection damper 17 pivots to open such that such a defective and its neighboring tablets are all ejected to a chute or shoot 19 provided below the defective rejection damper 17. On the other hand, while the defective rejection unit 9 is operated properly, the defective rejection damper 17 is closed, and thus non-defectives that have finished printing process are collected into a non-defective box (not shown) through the defective rejection damper 17 and the shoot 18. Alternatively, the non-defectives are transferred to a next process such as a packaging process though the shoot 18.

<Distributing Unit>

Figure 2:
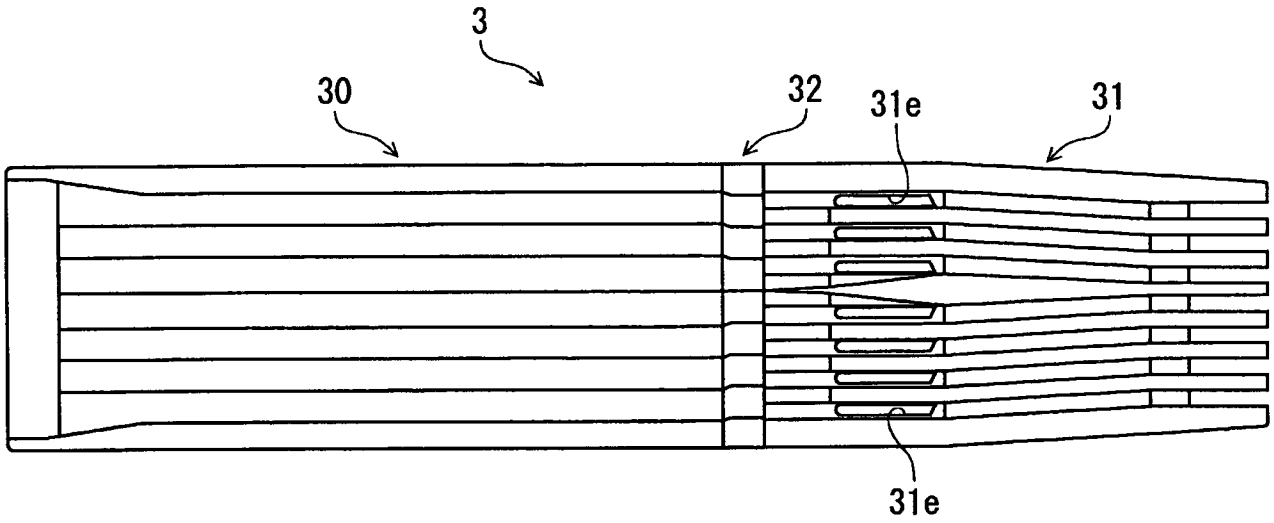
FIG. 2 is a schematic top plan view of a tablet distributing unit constituting the tablet printing apparatus.

FIGS. 2-12 show a distributing unit. As shown in FIG. 2, the distributing unit 3 is composed of a distributing trough 30, an aligning trough 31 disposed on a downstream side of the distributing trough 30, and an inclination correction trough 32 interposed between the distributing trough 30 and the aligning trough 31.

Figure 3:
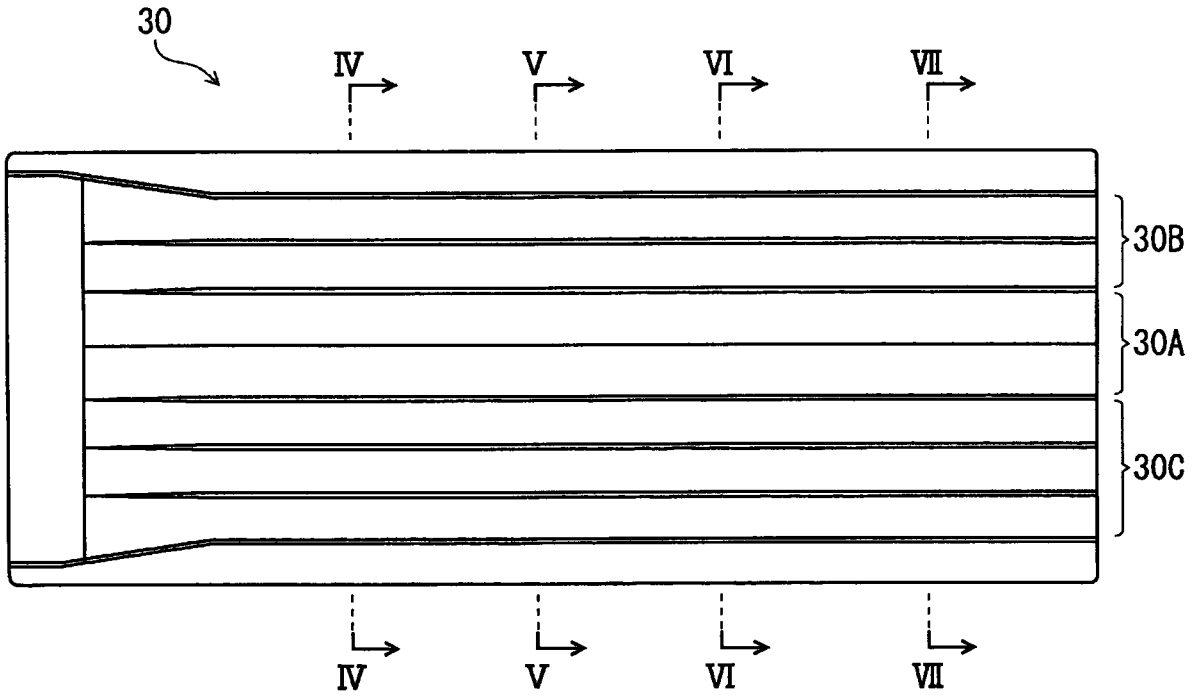
FIG. 3 is a top plan view of a distributing trough constituting the tablet distributing unit.

As shown in FIG. 3 and FIGS. 4-7, cross sectional views of FIG. 3 in a lateral direction, the distributing trough 30 includes a central dispersion part 30A of an inverted V-shape located centrally in the lateral direction and a plurality of distributing parts 30B, 30C each having an inverted V-shape and provided respectively on opposite sides of the central dispersion part 30A.

The central dispersion part 30A is adapted to disperse a large number of tablets T fed from the vibration feeder 20 (FIG. 1) laterally on opposite sides of the central dispersion part 30A. The central dispersion part 30A has a pair of inclined surfaces 30*a* each extending longitudinally along a direction of conveyance. The inclined surfaces 30*a* are preferably but not necessarily symmetrical.

The distributing parts 30B, 30C are adapted to distribute the tablets T from the central dispersion part 30A laterally in a plurality of rows. The distributing parts 30B, 30C includes a pair of longitudinally extending, asymmetrical inclined surfaces $\mathbf{30}b_1$, $\mathbf{30}b_2$ and $\mathbf{30}c_1$, $\mathbf{30}c_2$, respectively. The first inclined surfaces $\mathbf{30}b_1$, $\mathbf{30}c_1$ are located close to the central dispersion part 30A and the second inclined surfaces $\mathbf{30}b_2$, $\mathbf{30}c_2$ are located away from the central dispersion part 30A. The first inclined surfaces $\mathbf{30}b_1$, $\mathbf{30}c_1$ are more upright compared to the second inclined surfaces 30$b_2$, 30$c_2$. To the contrary, the second inclined surfaces 30$b_2$, 30$c_2$ are more inclined compared to the first inclined surfaces 30$b_1$, 30$c_1$.

Figure 4:
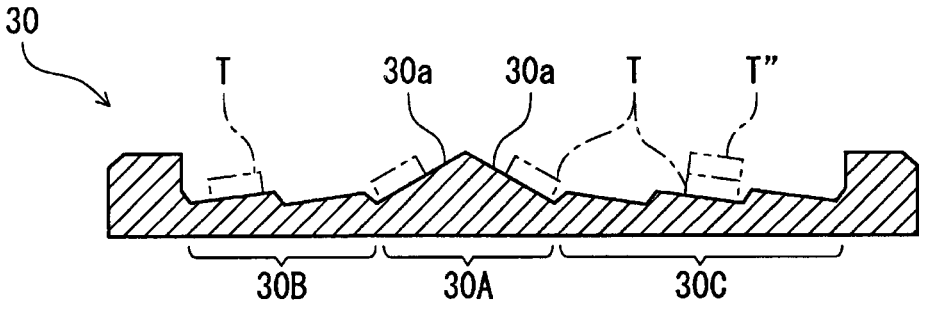
FIG. 4 is a cross sectional view of FIG. 3 taken along line IV-IV.
Figure 5:
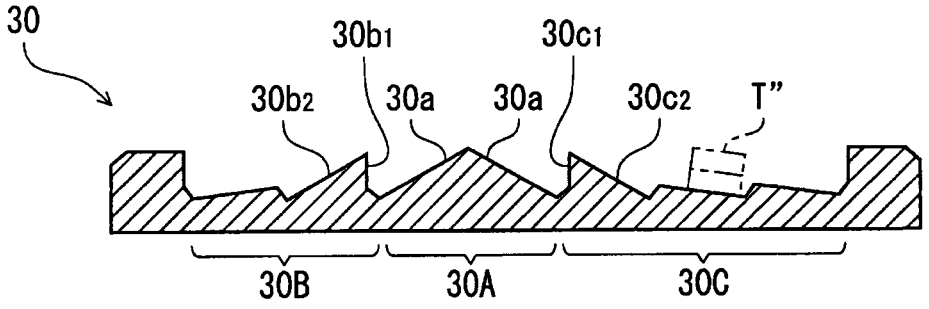
FIG. 5 is a cross sectional view of FIG. 3 taken along line V-V.
Figure 6:
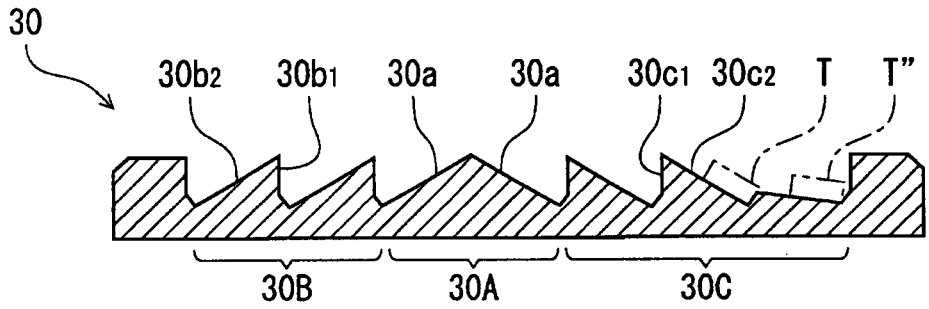
FIG. 6 is a cross sectional view of FIG. 3 taken along line VI-VI.
Figure 7:
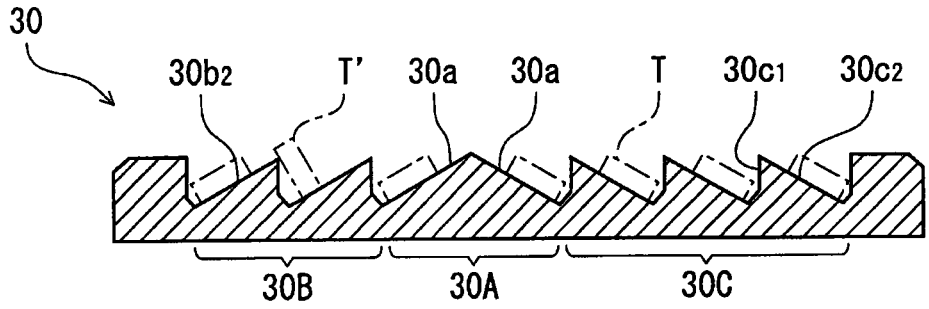
FIG. 7 is a cross sectional view of FIG. 3 taken along line VII-VII.

Also, heights of respective inverted V-shapes forming the distributing parts 30B, 30C respectively are made gradually greater from those on a side closer to the central dispersion part 30A as they go to a downstream side from a state of FIG. 4 through the states of FIGS. 5 and 6 to a state of FIG. 7. The reason is shown below.

As shown in FIG. 4, suppose that a tablet T" is overlaid on another tablet T and conveyed together with the tablet T. Since the inclined surface 30$c_2$ on which these tablets T" and T are placed becomes upright gradually and its height becomes greater as it progresses toward the downstream side of conveyance of the tablets, as shown in the order of FIGS. 5, 6, 7, the tablet T" will slip off the tablet T during conveyance and move onto an outside inclined surface 30$c_2$. Thereby, overlapping of the tablets on the inclined surface 30$c_2$ can be prevented. Also, since height of the inclined surfaces 30$b_2$, 30$c_2$ of the distributing parts 30B, 30C are made greater from a side closer to the central dispersion part 30A, in the event that a tablet is overlapped with another tablet on the inclined surfaces 30$b_2$, 30$c_2$ on the side closer to the central dispersion part 30A, such a tablet travels outside during conveyance so as to move onto the outside inclined surfaces 30$b_2$, 30$c_2$ step by step. Finally, at the downstream end of the conveyance direction, on each of the inclined surfaces 30$b_2$, 30$c_2$, the tablets are disposed one by one without overlapping with each other. In such a manner, a large number of tablets can be dispersed without overlapping on the respective inclined surfaces 30$a$, 30$b_2$, 30$c_2$ of the central dispersion part 30A and the distributing parts 30B, 30C.

As shown in FIG. 7, at a downstream end of the distributing trough 30, there are seven grooves of deformed V-shape formed side by side in the lateral direction. Each of the tablets T that have been dispersed and distributed laterally by the distributing trough 30 is placed and held at a diagonal state on the inclined surfaces 30$a$ of the central dispersion part 30A and the second inclined surfaces 30$b_2$, 30$c_2$ of the distributing parts 30B, 30C. A side surface of the tablet T is supported by the first inclined surfaces 30$b_1$, 30$c_1$ (see FIG. 7).

In contrast, if there are seven grooves of merely a rectangular shape formed side by side in the lateral direction from the upstream end to the downstream end of the distributing trough 30, it is likely that the tablets overlap each other in the rectangular-shaped groove and the tablets rise on the groove. Therefore, in such a distributing trough of rectangular shaped grooves, it is difficult to distribute the tablets in a plurality of rows.

In addition, FIG. 7 shows that tablet T' is inclined in a direction opposite a direction of tablet T such that a side surface of tablet T' is supported by the second inclined surface 30$b_2$, either a front surface or a back surface thereof is supported by the first inclined surface 30$b_1$, and tablet T' is more upright compared to tablet T. We will explain that later.

Also, in this exemplification, the central dispersion part 30A is not located at a precisely central position of the distributing trough 30 in the lateral direction, but that is because the number of distributing parts 30B is two, the number of distributing parts 30C is three and they are different. If the number of distributing parts 30B is equal to the number of distributing parts 30C, then the central dispersion part 30A is located at a precisely central position of the distributing trough 30 in the lateral direction. In FIGS. 5 and 6, tablets T are omitted for illustration purposes.

Figure 8:
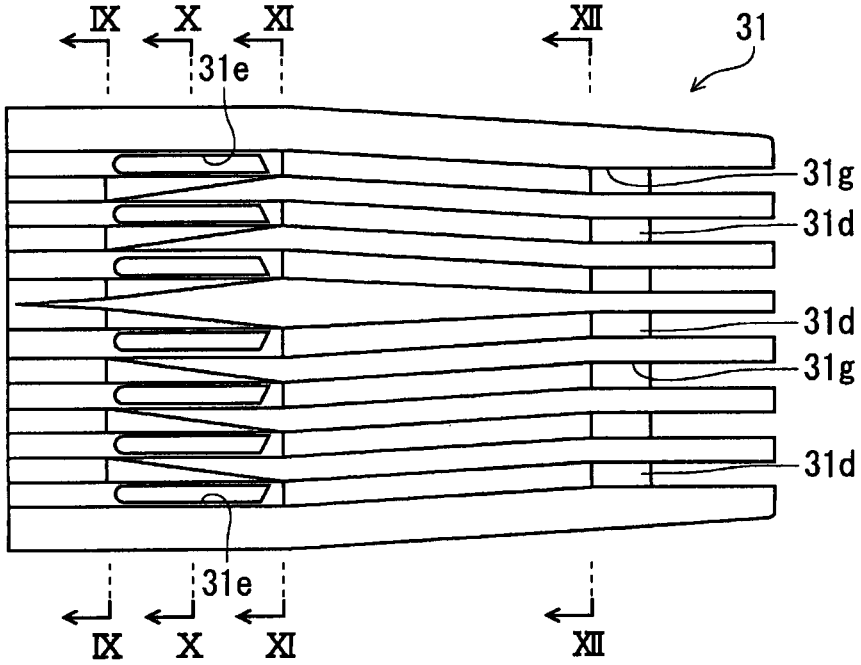
FIG. 8 is a top plan view of an aligning trough constituting the tablet distributing unit.
Figure 9:
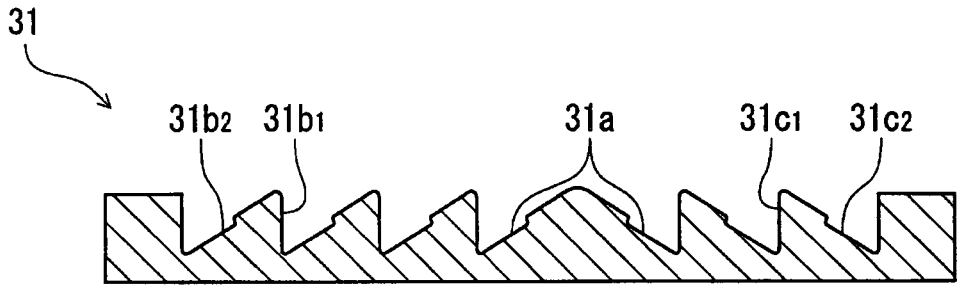
FIG. 9 is a cross sectional view of FIG. 8 taken along line IX-IX.
Figure 10:
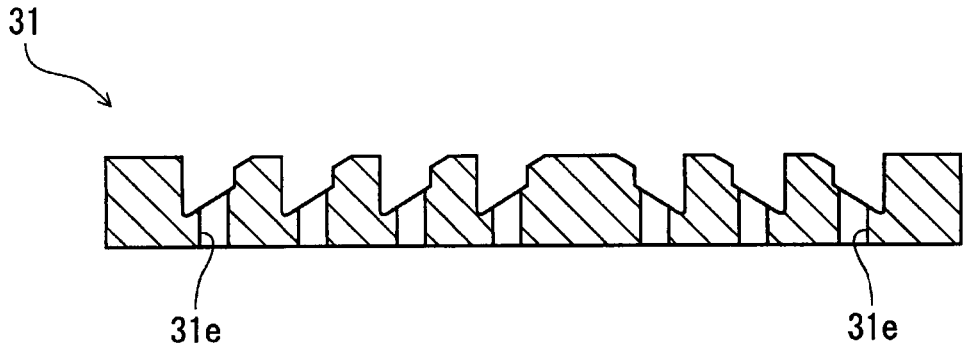
FIG. 10 is a cross sectional view of FIG. 8 taken along line X-X.
Figure 11:
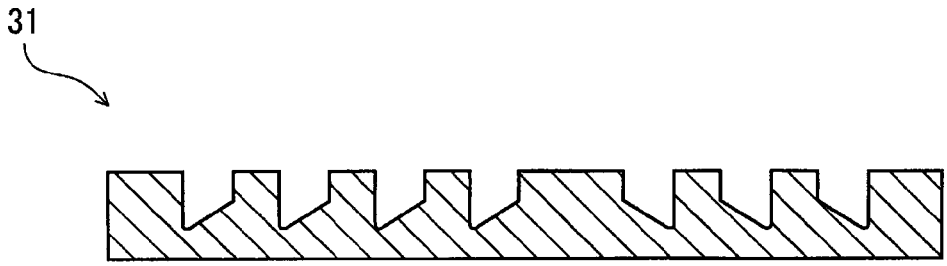
FIG. 11 is a cross sectional view of FIG. 8 taken along line XI-XI.

As shown in FIGS. 8 and 9, the aligning trough 31 at an upstream end has a cross sectional shape similar to a cross sectional shape (see FIG. 7) of the distributing trough 30 at the downstream end, but as it progresses toward a downstream side shown in FIGS. 9 to 12, each of the grooves of deformed V-shape in cross section gradually changes into a rectangular shape in cross section. Therefore, on a downstream side of the aligning trough 31, the tablets T are housed in the corresponding rectangular-shaped grooves 31$g$ and maintained horizontally. At a downstream end of the aligning trough 31, each of the groove 31$g$ does not have a bottom portion 31$d$ and thus it opens downwardly (see FIG. 8). As shown in FIGS. 8 and 10, on an upstream side of the aligning trough 31, elongated through holes 31$e$ are formed thereinto to downwardly discharge dust that has been generated by contact of the tablets with other tablets or the trough, and chipped tablets or chips of the tablets that have been mixed in a previous process. In FIGS. 9 to 11, the tablets T are omitted for illustration purposes.

Figure 12:
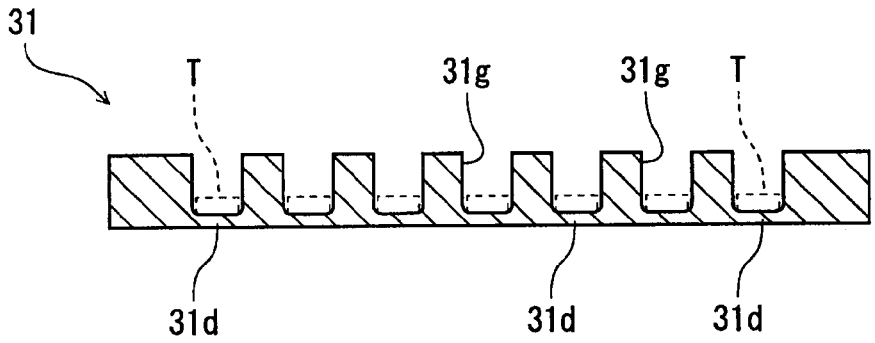
FIG. 12 is a cross sectional view of FIG. 8 taken along line XII-XII.
Figure 12A:
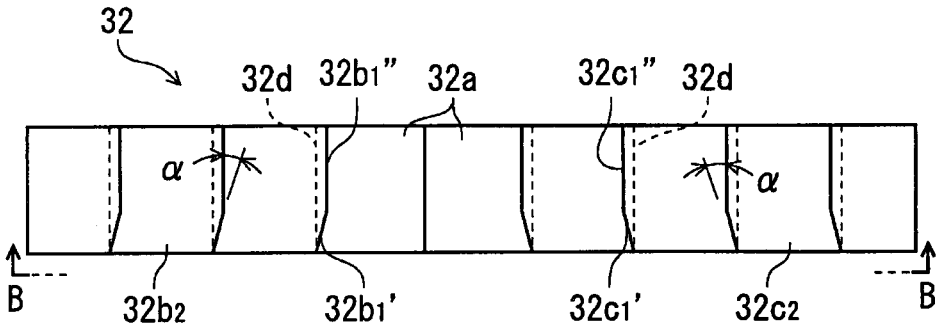
FIG. 12A is a top plan view of an inclination correction trough disposed between the tablet distributing unit and the aligning trough.
Figure 12B:
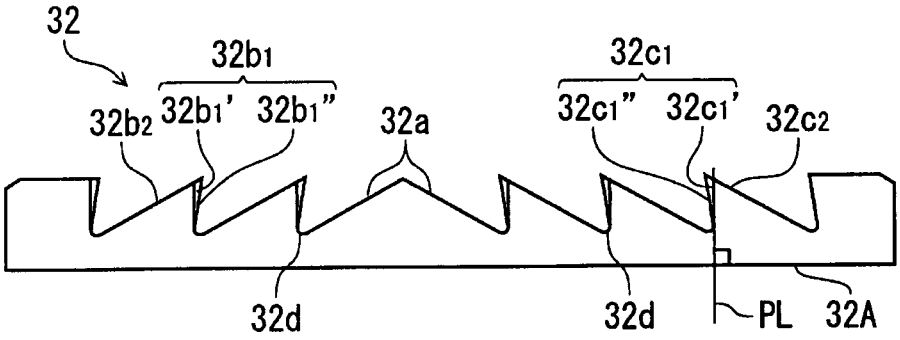
FIG. 12B is a side view of FIG. 12A viewed from line B-B.

The aligning trough 32 is adapted to tilt a tablet (e.g. tablet T' in FIG. 7), which has been placed upright and inclined in a reverse direction of the other tablets (e.g. tablet T in FIG. 7), in a normal direction during conveyance of the distributing trough 30. As shown in FIG. 12A, a top plan view, and FIG. 12B, a side view of FIG. 12A viewed from line B-B, the inclination correction trough 32 has a pair of inclined surfaces 32$a$ disposed at a position corresponding to the central dispersion part 30A of the distribution trough 30 and a plurality of pairs of inclined surfaces 32$b_1$, 32$b_2$, and 32$c_1$, 32$c_2$ respectively disposed on opposite sides of the inclined surfaces 32$a$ and having asymmetrical shapes. These inclined surfaces 32$b_1$, 32$b_2$, and 32$c_1$, 32$c_2$ extend in a direction of conveyance (i.e. up-and-down direction of FIG. 12A and vertical direction of FIG. 12B). By the inclined surfaces 32$b_1$, 32$b_2$, and 32$c_1$, 32$c_2$, seven grooves each having deformed V-shape and extending in the longitudinal conveyance direction are formed in the lateral width direction. Each of the inclined surfaces 32$a$ is formed in a shape corresponding to each inclined surface of the central dispersion part 30A of the distribution trough 30 and preferably symmetrical.

The first inclined surfaces 32$b_1$, 32$c_1$ are disposed on a side closer to the inclined surface 32$a$ and the second inclined surfaces 32$b_2$, 32$c_2$ are disposed on a side away from the inclined surface 32$a$. The first inclined surfaces 32$b_1$, 32$c_1$ are placed in a more upright state compared to the second inclined surfaces 32$b_2$, 32$c_2$. In contrast, the second inclined surfaces 32$b_2$, 32$c_2$ are placed in a more inclined state compared to the first inclined surfaces 32$b_1$, 32$c_1$.

Each of the first inclined surfaces 32$b_1$ is formed of an inclined surface 32$b_1$' disposed at an upstream end (i.e. a lower end of FIG. 12A) and an inclined surface 32$b_1$" extending toward a downstream direction (i.e. an upward direction of FIG. 12A) from the inclined surface 32$b_1$'. Similarly, each of the first inclined surfaces 32$c_1$ is formed of an inclined surface 32$c_1$' disposed at an upstream end (i.e. a lower end of FIG. 12A) and an inclined surface 32$c_1$" extending toward a downstream direction (i.e. an upward direction of FIG. 12A) from the inclined surface 32$c_1$'. As viewed from above, each of the inclined surfaces 32$b_1$', 32$c_1$' is slanted at an angle of a relative to the inclined surfaces 32$b_1$", 32$c_1$", respectively.

Each of the inclined surfaces 32$b_1$", 32$c_1$" extends in a flat shape upwardly (i.e. an upward direction of FIG. 12B) from a bottom portion 32$d$ of the groove, but slants toward an inside of the groove relative to an imaginary perpendicular line PL drawn at the bottom portion 32$d$ of the groove and extending in a direction perpendicular to a bottom surface 32A of the inclination correction trough 32. Each of the inclined surfaces 32$b_1$', 32$c_1$' extends linearly and upwardly (i.e. an upward direction of FIG. 12B) from the bottom portion 32$d$ of the groove along the perpendicular line PL at the upstream end (i.e. a lower end of FIG. 12A) of each of the inclined surfaces 32$b_1$', 32$c_1$', but at a region from the upstream end to a connection portion with the second inclined surfaces 32$b_1$", 32$c_1$", each of the inclined surfaces 32$b_1$', 32$c_1$' extends upwardly from the bottom portion 32*d* of the groove in a flat shape and slants inwardly toward the groove relative to the perpendicular line PL.

Figure 12C:
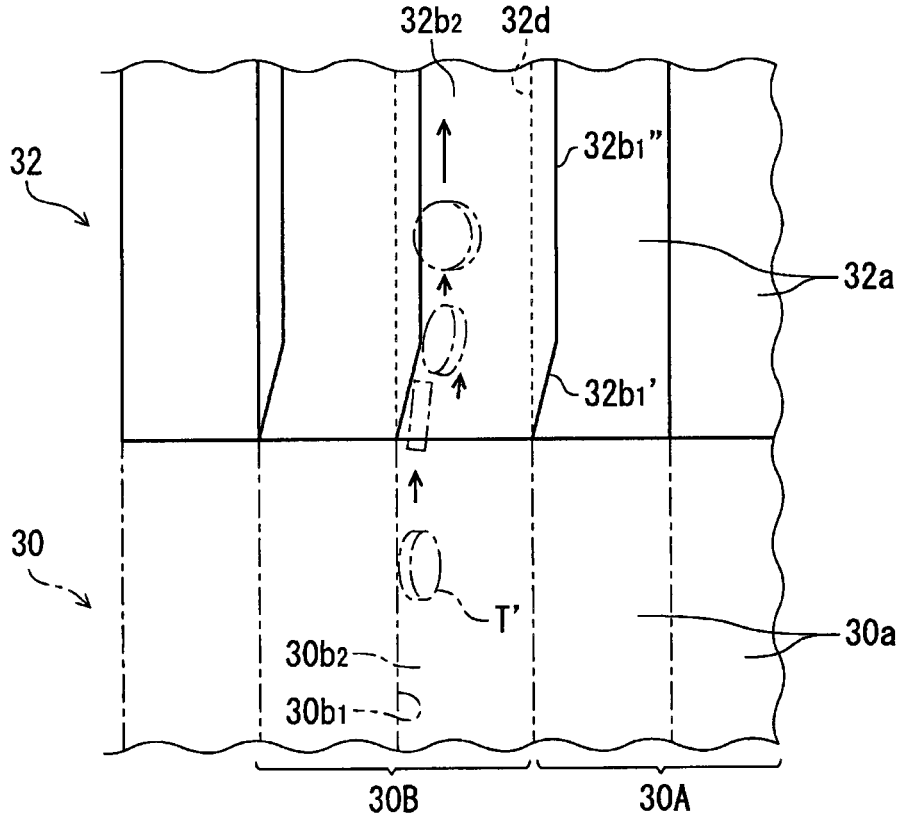
FIG. 12C is a schematic illustrating a function of the inclination correction trough of FIG. 12A.

Thereby, as the tablet T' in FIG. 7 that has been upright and slanted in a reverse direction relative to the other tablets T in the distributing trough 30 is introduced into the inclination correction trough 32 as shown in FIG. 12C and a front surface or a back surface of the tablet T' comes into contact with the inclined surface 32$b_1$' of the inclination correction trough 32, the tablet T' becomes more upright due to a protruded portion pushed out from the inclined surface 32$b_1$' over the groove. While the tablet T' travels to the inclined surface 32$b_1$', as the amount of protrusion of the inclined surface 32$b_1$' becomes greater, the tablet T' is caused to fall down in a direction opposite a direction of the tablet at the time of introduction into the inclination correction trough 32. As a result, the tablet T' is placed on the inclined surface 32$b_2$ of the groove and transferred downstream in that state along the groove. On the other hand, tablets T that were placed on the inclined surfaces 30*a*, 30$b_2$, 30$c_2$ of the distributing trough 30 and that have been introduced into the inclination correction trough 32 are transferred downstream in the state that the tablets T are placed on the inclined surfaces 32*a*, 32$b_2$, 32$c_2$.

Preferably, the distributing trough 30, the aligning trough 31 and the inclination correction trough 32 are surface-treated by for example, TUFRAM® or the like to allow the tablets T, T' to slide more easily in the grooves.

<First Conveyor>

Figure 13:
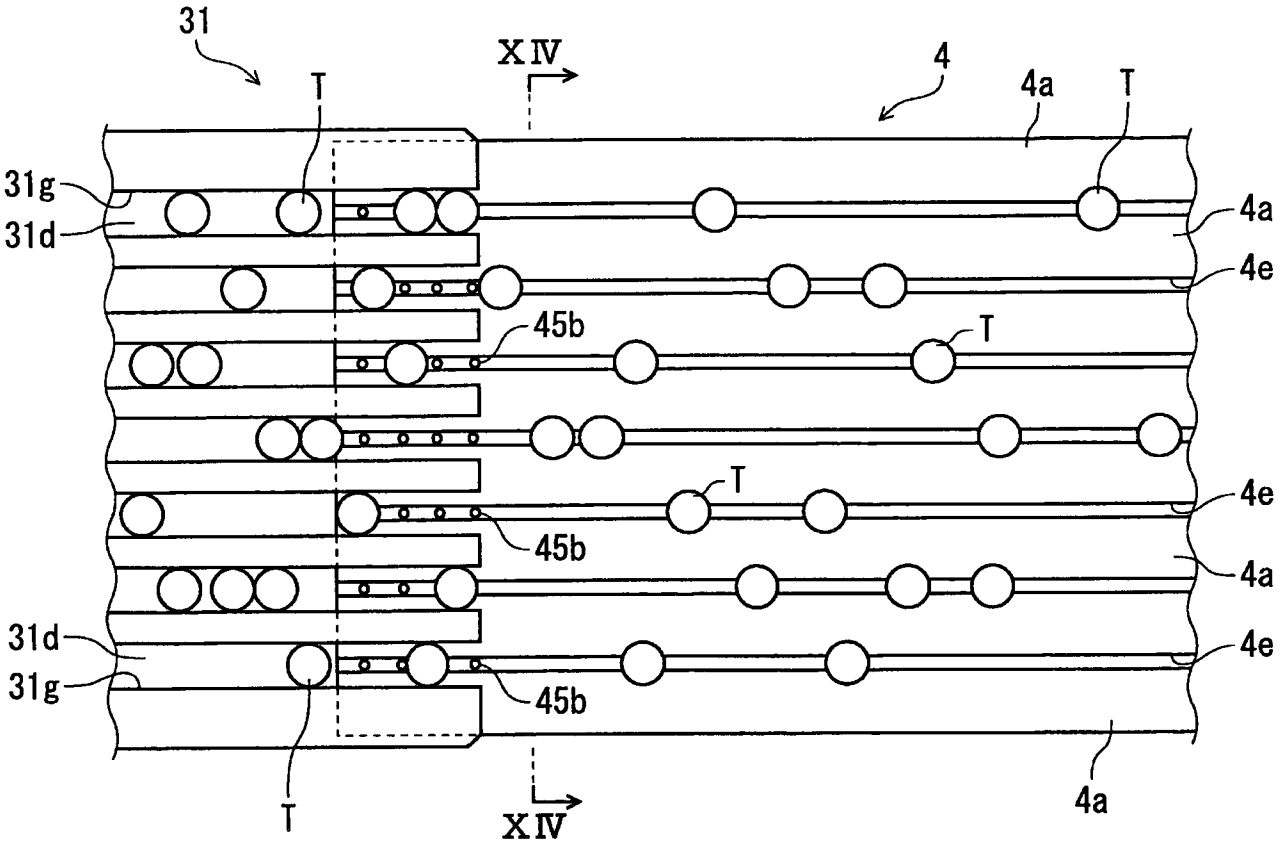
FIG. 13 is a schematic top plan view of a downstream end of the aligning trough and an upstream end of a first conveyor connected to the downstream end of the aligning trough.
Figure 14:
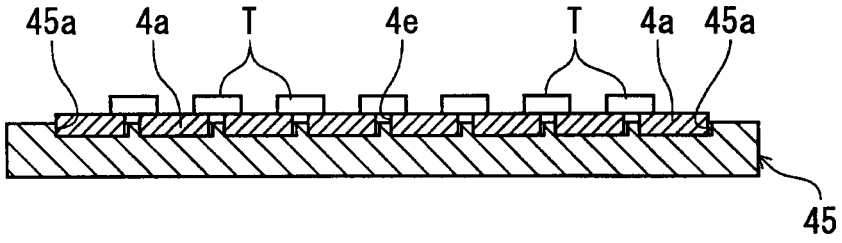
FIG. 14 is a cross sectional view of FIG. 13 taken along line XIV-XIV.
Figure 15:
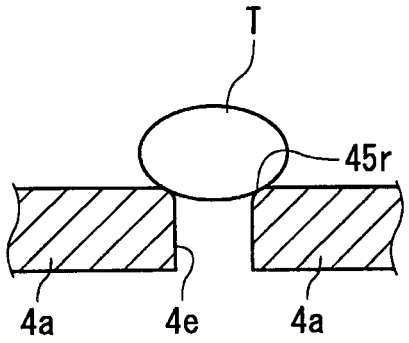
FIG. 15 is an enlarged view of a portion of an alternative embodiment of FIG. 14.

FIGS. 13 to 15 show a first conveyor. As shown in FIG. 13, an upstream end of the first conveyor 4 is disposed below and overlapped with a downstream end of the aligning trough 31. The first conveyor 4 is formed of a plurality of (e.g. eight in this example) pieces of timing belts 4*a* that are spaced side by side via a gap 4*e* in a lateral width direction perpendicular to a longitudinal conveyance direction (i.e. left to right direction of FIG. 13). Each of the gaps 4*e* is located centrally in the lateral width direction in each of the grooves 31*g* of the aligning trough 31. As shown in FIG. 14, below the first conveyor 4, a support plate 45 is provided that extends in the lateral width direction as well as in the longitudinal conveyance direction of the first conveyor 4. On a top surface of the support plate 45, eight pieces of grooves 45*a* extending in the longitudinal conveyance direction of the first conveyor 4 are formed at regular intervals. The timing belts 4*a* are slidably placed in the corresponding grooves 45*a*.

Between the adjacent grooves 45*a*, the support plate 45 is formed with a plurality of suction holes 45*b* to suction air (see FIG. 13). Upper openings of the suction holes 45*b* face the gaps 4*e* between the laterally adjacent timing belts 4*a*. Suction of air through the suction holes 45*b* allows for the tablets T to be suction-held on the gaps 4*e* between the laterally adjacent timing belts 4*a*.

In FIG. 13, the suction holes 45*b* are provided only at a region where the upstream end of the first conveyor 4 is overlapped with the downstream end of the aligning trough 31, but the suction holes 45*b* may be provided along the entire conveyance direction of the first conveyor 4.

In this case, when the tablets T are transferred from the aligning trough 31 to the first conveyor 4, and also while the tablets T are conveyed by the first conveyor 4, the tablets T can be prevented from being dropped out of the first conveyor 4, vibrated or slid of the normal position on the first conveyor 4. As a result, the tablets T can be conveyed at high speed and printing on the tablets T at a precise position thereof can be carried out.

In the event that the suction holes 45*b* are provided only at the region where the upstream end of the first conveyor 4 and the downstream end of the aligning trough 31 are overlapped with each other, the tablets T are suction-held through the suction holes 45*b* only when the tablets T are transferred from the aligning trough 31 to the first conveyor 4 and the tablets T are not suction-held during conveyance of the first conveyor 4, the rate of conveyance of the first conveyor 4 cannot be made so fast, but even in such a case, since the first conveyor 4 in this embodiment is formed of a plurality of timing belts 4*a*, a large number of tablets T can be conveyed at a plurality of rows and thus process speed per one tablet can be enhanced.

FIG. 14 exemplifies flat tablets as an example of tablets T, but in the case of R tablets, as shown in FIG. 15, an R-shaped chamfer 45*r* is preferably formed at a corner portion of each of the timing belts 4*a* that contacts an R tablet. That is because scratches on a surface of R tablet due to a point-contact of R tablet with the corner of the timing belt 4*a* can be prevented from occurring. Also, in this case, by provision of the R-shaped chamfer 45*r*, R tablet is seated at the gap 4*e* between the adjacent timing belts 4*a* (see FIG. 15) and thus R tablet, which is easy to tilt during conveyance, can be conveyed stably.

<First Line Sensor Camera>

Figure 16:
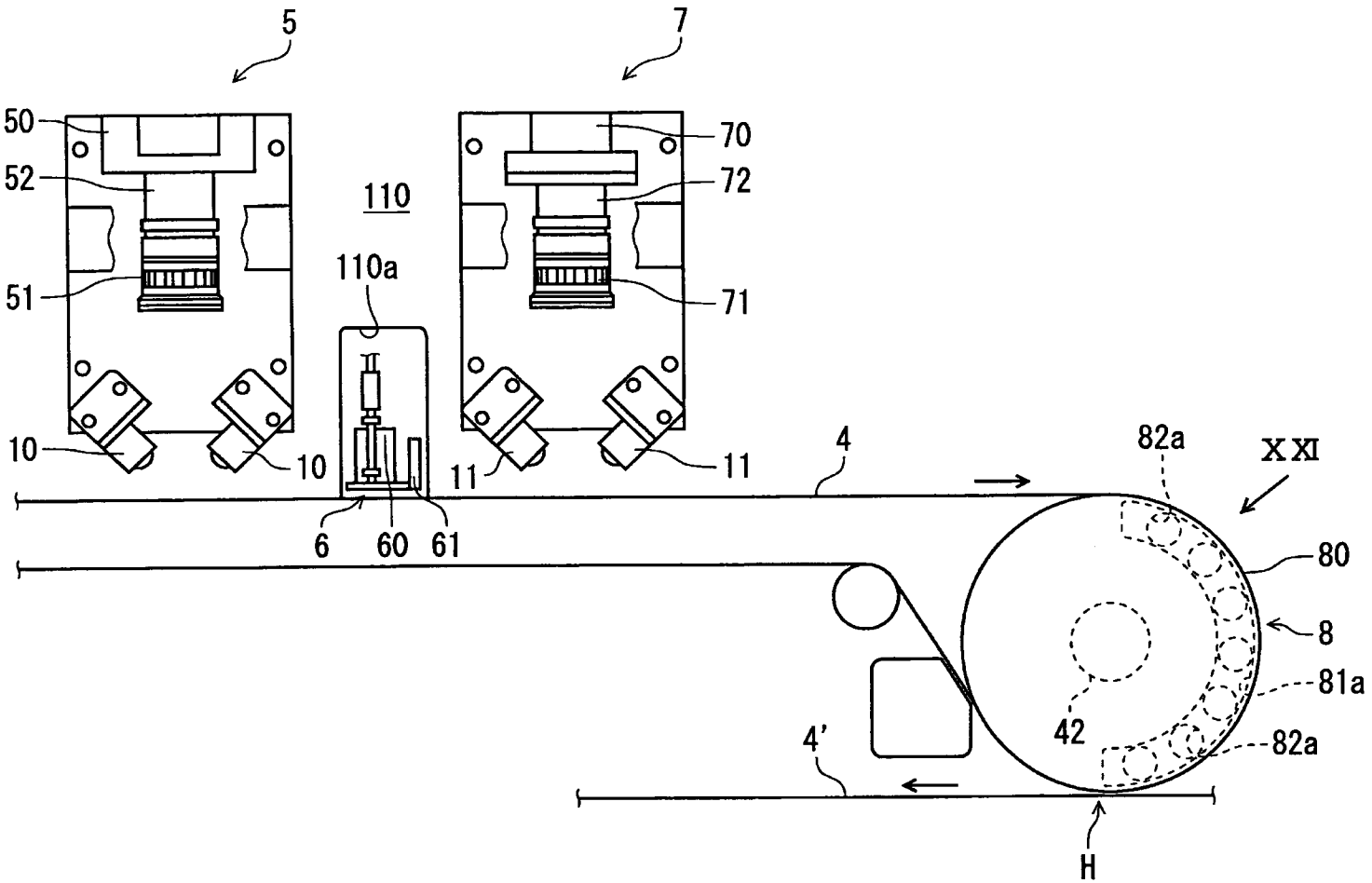
FIG. 16 is a schematic front elevational view of a first detection line sensor camera, a first inspection line sensor camera and a first inkjet printer that are disposed on a side of the first conveyor to constitute the tablet printing apparatus, also showing a reversing unit.
Figure 17:
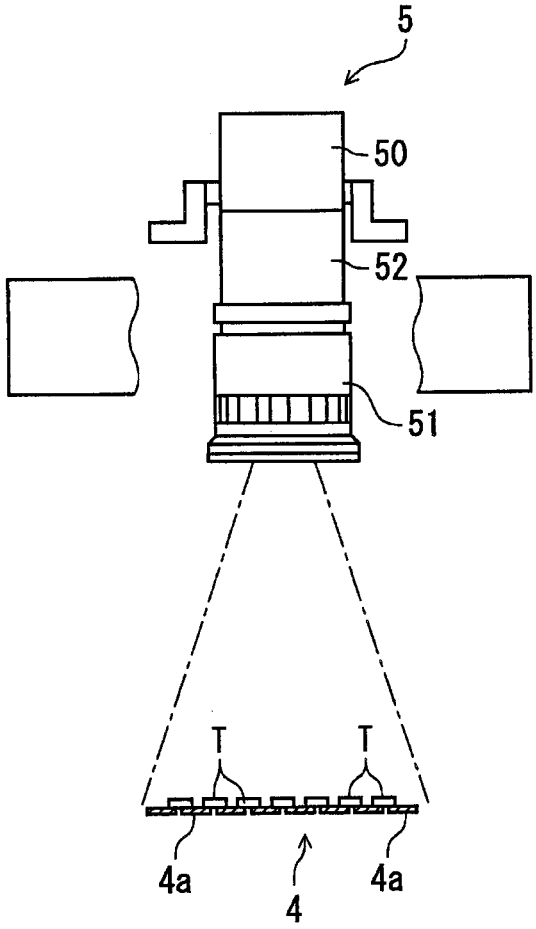
FIG. 17 is a side schematic view of the first inspection line sensor camera.
Figure 18:
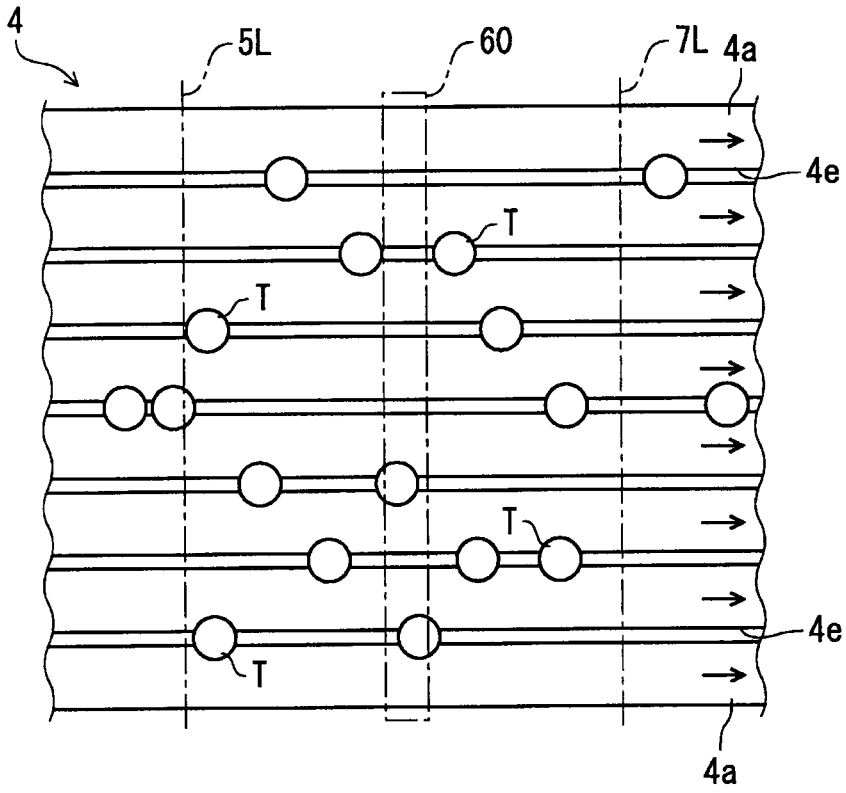
FIG. 18 is a top plan view of a portion of the first conveyor showing positions of shooting lines of the first detection line sensor camera and the first inspection line sensor camera and a disposition of a first inkjet head.

FIGS. 16 to 18 show the first detection and inspection line sensor cameras. As shown in FIG. 16, the first detection line sensor camera 5 has a line sensor (or CMOS sensor) 50, and a camera lens 51 fitted to the line sensor 50 through a lens mount 52. As shown in FIGS. 17 and 18, a shooting line 5L of the first detection line sensor camera 5 extends along the lateral width direction of the first conveyor 4. Therefore, as the first detection line sensor camera 5 starts shooting (i.e. line scanning) during conveyance of tablets T by the first conveyor 4, though a row of pixel is merely obtained while the first conveyor 4 is stopped, since the first conveyor 4 is traveling in this case, a large amount of area data with a large number of pixels can be obtained compared to an area sensor.

Detection data of tablet T detected by the line sensor camera 50 of the first detection line sensor camera 5 includes information of the tablets relating to types, positions (or orientations), heads or tails of the tablets T and so on. At the time of shooting, the first detection line sensor camera 5 is synchronized with the rate of travel of tablet T (i.e. the rate of conveyance of the first conveyor 4).

As shown in FIG. 16, the first inspection line sensor camera 7, similar to the first detection line sensor camera 5, has a structure with a line sensor (or CMOS sensor) 70 and a camera lens 71 fitted to the line sensor 70 through a lens mount 72. As shown in FIG. 18, a shooting line 7L of the first inspection line sensor camera 7 as well extends along the lateral width direction of the first conveyor 4. Therefore, as the first inspection line sensor camera 7 starts shooting (i.e. line scanning) during conveyance of tablets T by the first conveyor 4, though a row of pixel is merely obtained while the first conveyor 4 is stopped, since the first conveyor 4 is traveling in this case, a large amount of area data with a large number of pixels can be obtained compared to an area sensor.

Inspection data of tablet T detected by the line sensor camera 70 of the first inspection line sensor camera 7 includes information of tablets relating to printing failure such as blurred printing, out-of-place printing, and the like. At the time of shooting, the first inspection line sensor camera 7 as well is synchronized with the rate of travel of tablet T (i.e. the rate of conveyance of the first conveyor 4).

When a defective such as printing failure is detected by the first inspection line sensor camera 7, positional information of this defective is registered as information on the first conveyor 4 (after reverse of tablets as information on the second conveyor 4'). In such a way, the defective is rejected by the defective rejection unit 9 during conveyance of the second conveyor 4'.

Below the first detection line sensor camera 5, a pair of lighting units 10 are provided to cast light on tablets on the first conveyor 4, more precisely, on the shooting line 5L of the first detection line sensor camera 5. Likewise, below the first inspection line sensor camera 7, a pair of lighting units 11 are provided to cast light on tablets on the first conveyor 4, more precisely, on the shooting line 7L of the first inspection line sensor camera 7.

In addition, since most tablets are generally white, for example, by blackening surfaces of the timing belts 4*a* of the first conveyor 4, stronger contrast can be obtained at the time of shooting by the line sensor cameras 5, 7.

<First Inkjet Printer>

FIGS. 16, 18 to 20 show the first inkjet printer. As shown in FIG. 16, the first inkjet printer 6 is interposed between the first detection line sensor camera 5 and the first inspection line sensor camera 7 and preferably has a line-head-type first inkjet head (or IJP head) 60. The first inkjet head 60 is fitted to a support plate 61 and as shown in FIG. 18, it extends along the lateral width direction of the first conveyor 4. Also, the first inkjet printer 6 is movable into and out of an aperture 110*a* formed through a front panel 110 of the tablet printing apparatus 1.

Figure 19:
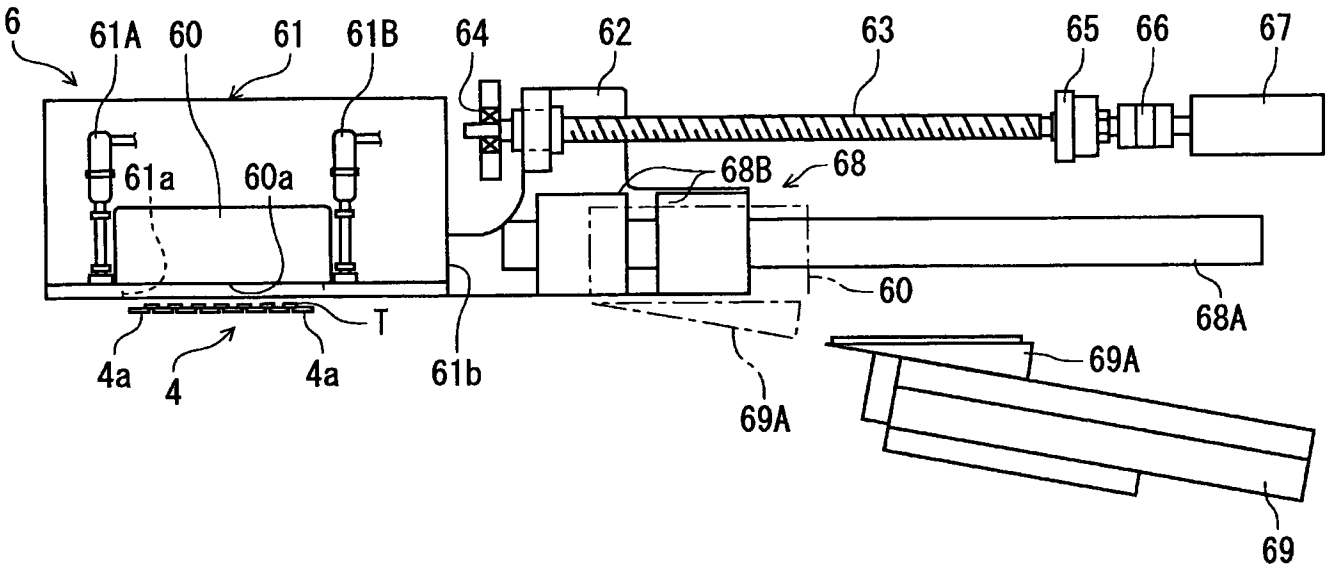
FIG. 19 is a side schematic view of the first inkjet head and its drive mechanism.

As shown in FIG. 19, the inkjet head 60 has a connector 61A for ink introduction connected to an end of the inkjet head 60 and a connector 61B for ink discharge (or air discharge at the time of filling-up of ink) connected to the other end of the inkjet head 60. The support plate 61 has a through hole 61*a* formed therein for discharged ink from the inkjet head to pass through. A bracket 62 is fixedly attached to a rear end 61*b* of the support plate 61. There is provided a ball screw 63 that extends in the longitudinal direction (i.e. the left to right direction of FIG. 19) and that is in screwing engagement with the bracket 62. A front end and a rear end of the ball screw 63 are supported rotatably by bearings 64, 65. The rear end of the ball screw 63 is drivingly connected to an output of a servomotor 67 via coupling 66. A linear motion (LM) guide 68 is fitted to the bracket 62 to guide travel of the bracket 62 during rotation of the ball screw 63. The LM guide 68 is composed of an LM rail 68A extending in the longitudinal direction and an LM block 68B slidable on the LM rail 68A and fixedly attached to the bracket 62.

Drive of the servomotor 67 rotates the ball screw 63 to cause the first inkjet head 60 to move in the longitudinal direction or in a direction of rows of tablets (see an arrow marked direction in FIG. 20) through the bracket 62 and the support plate 61. The first inkjet printer 6 is adapted to take a printing position where the inkjet head 60 is disposed above the first conveyor 4 (see a dash-and-dot line of FIG. 18 and a solid line of FIG. 19) and a retracted position where the inkjet head 60 is retracted at the back of the front panel 110 (see a dash-and-dot line of FIG. 19). The retracted position is provided for maintenance work and so on including purging or wiping of the inkjet head 60 to clean up the inkjet head 60 by discharging ink or maintenance fluid.

As shown in FIG. 19, there is provided a lid 69A below the LM guide 68 to cover a head surface 60*a* of the inkjet head 60 disposed at the retracted position to prevent dry of the head surface 60*a*. At a bottom portion of the lid 69A, there is provided a lid drive unit 69 to move the lid 69A diagonally upward toward the head surface 60*a* of the inkjet head 60 disposed at the retracted position. The lid drive unit 69 is structured by for example, a pneumatic cylinder.

The inkjet head 60 employs for example, piezo method. When printing, information data such as positions, orientations, heads or tails of tablets T detected by the first detection line sensor camera 5 is processed at high-speed, and based on the result of the process, data as to which nozzle of the inkjet head 60 should discharge ink is transferred to the inkjet head 60. A printing position of the inkjet head 60 is not changed.

Figure 20:
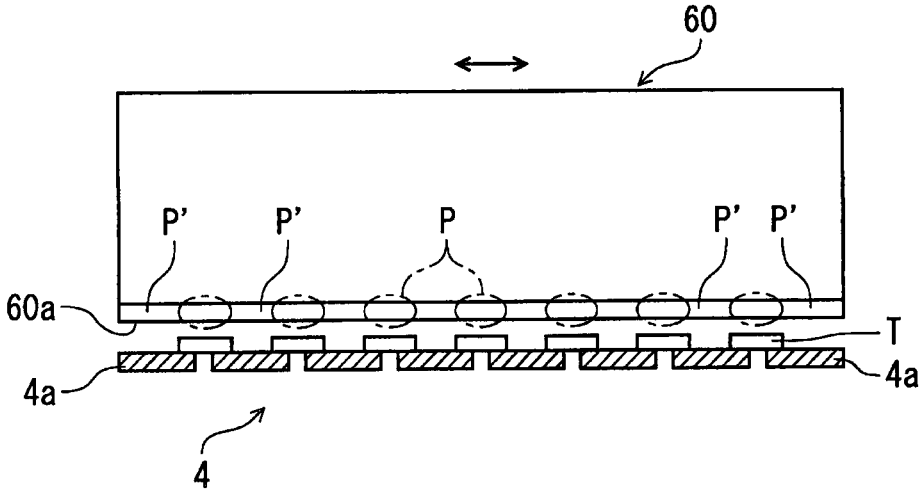
FIG. 20 is an enlarged side schematic view of the first inkjet head, also showing tablets on the first conveyor.

That is, as shown in FIG. 20, when the inkjet head 60 is disposed at the printing position to carry out printing process, ink discharging regions of the inkjet head 60 are fixed at a plurality of regions P enclosed by a dash-and-dot line and a region P' between the adjacent regions P does not discharge ink. Accordingly, in order to prevent clogging of a dry nozzle due to prolonged disuse, when the inkjet head 60 returns to the printing position again after the inkjet head 60 moved to the retracted position at maintenance work, the inkjet head 60 is transferred to a position different from the previous printing position by changing the position of the inkjet head 60 by a few millimeters, and by compensating the amount of deviation of positions, printing process after returning to the printing position can be carried out properly.

Also, at the time of printing, printing timing of the inkjet printer 6 is synchronized with the moving speed of tablet T (i.e. conveyance speed of the first conveyor 4), thereby allowing for the printing process of the tablet T during conveyance to be conducted precisely.

<Reversing Unit>

Figure 21:
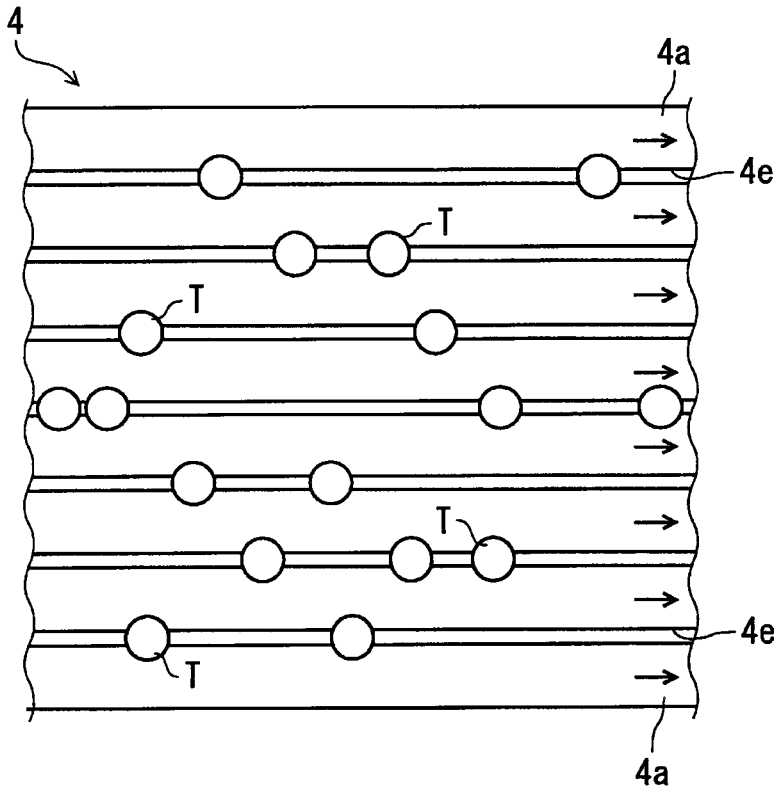
FIG. 21 is a partial top plan view of FIG. 16 viewed from a direction of an arrow mark XXI.
Figure 22:
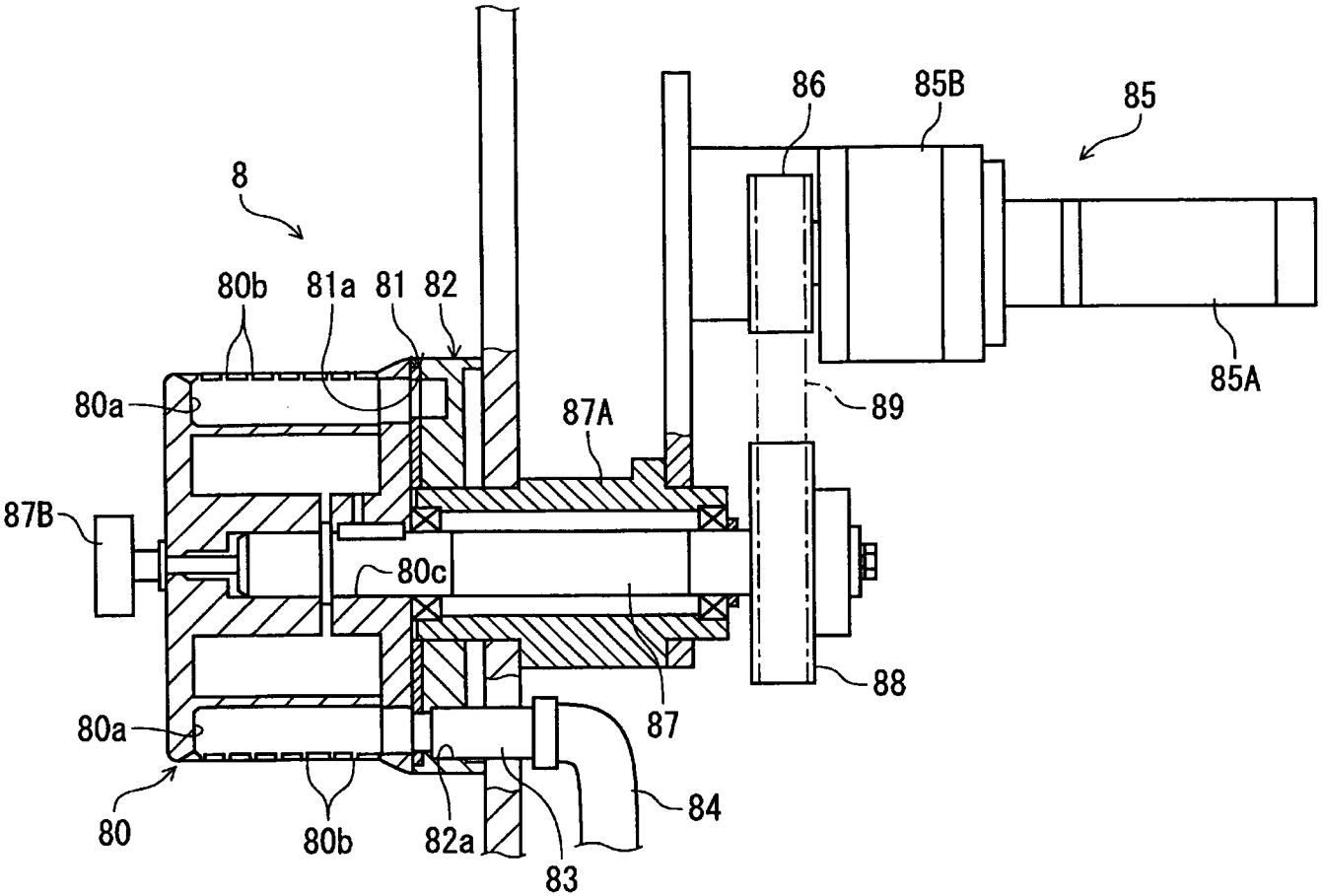
FIG. 22 is a side schematic diagram illustrating a reversing roller of the reversing unit of the tablet printing apparatus together with its drive mechanism.

FIGS. 16, 21 and 22 show a reversing unit. As shown in FIG. 16, the reversing unit 8 has a reversing roller 80 which the first conveyor 4 is wrapped around. As shown in FIG. 22, inside the reversing roller 80, a plurality of chambers 80*a* are provided and spaced apart from each other around an outer circumference of the reversing roller 80. Each of the chambers 80*a* extends radially and axially inside the reversing roller 80 and opens at an end of the reversing roller 80 in an axial direction. Also, each of the chambers 80*a* has a plurality of suction holes 80*b* that open at an outer circumferential surface of the reversing roller 80 and that suction tablets on the first conveyor 4. Each of the suction holes 80*b* is located at a position corresponding to a space 4*e* between the adjacent timing belts 4*a* constituting the first conveyor 4 when the first conveyor 4 is wrapped around the reversing roller 80.

At an end surface on an opening side of the chambers 80*a* of the reversing roller 80, a round-shaped plate 81 is provided. The plate 81 has a suction chamber 81*a* formed thereinto that extends in a semicircular shape along an outer circumferential surface and that provides a connection to each of the chambers 80*a* of the reversing roller 80 (see FIG. 16). The plate 81 is fitted to a base 82. The base 82 has a plurality of through holes 82*a* formed therein at positions where they overlap with the suction chamber 81*a* of the plate 81 (see FIG. 16). Each of the through holes 82*a* is connected to a connector 83 (in FIG. 22, only the connector 83 on a lower side is shown), which is connected to a suction hose 84 for air suction (in FIG. 22, only the suction hose 84 on a lower side is shown). The base 82 is pressed against an end surface of the reversing roller 80 through action of an adjustment screw (not shown).

When suctioning air from the suction hoses 84, air is also suctioned through the through holes 82*a*, the suction chamber 81*a*, the cambers 80*a*, and the suction holes 80*b*, and thus tablets T on the first conveyor 4 are suction-held on the first conveyor 4 even during travel along the outer perimeter of the reversing roller 80 (see FIG. 21).

As shown in FIG. 16, the suction chamber 81*a* extends to a transfer point H where the tablets T on the reversing roller 80 are transferred to the second conveyor 4'. Accordingly, suction by the suction chamber 81*a* is conducted till the tablets T are transferred from the reversing roller 80 to the second conveyor 4'. On a downstream side of the transfer point H, the tablets T are not suction-held by the reversing roller 80, and the tablets T may be suction-held by suction holes (not shown) provided at the second conveyor 4'.

As shown in FIG. 22, a drive mechanism of the reversing unit 8 includes a reduction geared servomotor 85 in which a reduction gear 85B is connected to a servomotor body 85A. A timing pulley 86 is fitted to an output of the servomotor 85. Beside the servomotor 85, there is provided a rotational shaft 87 supported rotatably around a bracket 87A. A timing pulley 88 is fitted to an end of the rotational shaft 87. A timing belt 89 is wrapped around the timing pulleys 86, 88. The other end of the rotational shaft 87 is inserted into and in key-engagement with a hole 80*c* formed in the center of the reversing roller 80. A lock screw 87B is in screwing engagement with an end surface of the other end of the rotational shaft 87 to lock the reversing roller 80 axially relative to the rotational shaft 87.

Figure 23A:
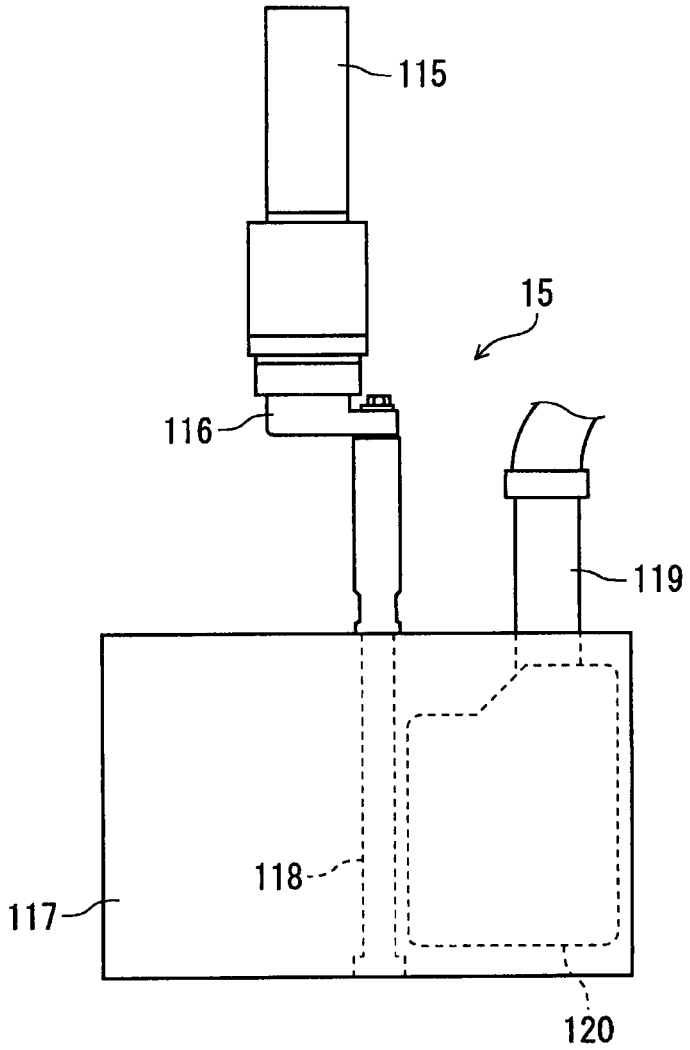
FIG. 23A is a schematic top plan view of a height adjusting unit provided at a second conveyor.
Figure 23B:
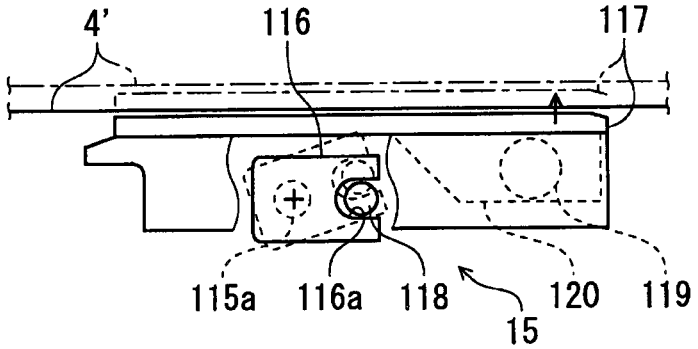
FIG. 23B is a schematic front elevational view of FIG. 23A.

There is provided a height adjusting unit 15 (see FIG. 1) below the reversing roller 80 on the upstream side of the second conveyor 4' to adjust a gap between the second conveyor 4' and the reversing roller 80. As shown FIGS. 23A and 23B, the height adjusting unit 15 includes a servomotor 115 and a lever 116 fitted to an output 115*a* of the servomotor 115. The lever 116 has a cutout 116*a* formed at a distal end thereof. There is provided a support shaft 118 extending longitudinally (i.e. to the up and down direction of FIG. 23A) and an end of the support shaft 118 is engaged with the cutout 116*a* of the lever 116. Below the second conveyor 4', there is provided a plate 117 movable up and down and extending in the lateral width direction of the second conveyor 4'. A portion of the support shaft 118 is coupled to a bottom surface of the plate 117.

Drive of the servomotor 115 rotates the lever 116 to cause the plate 117 to move upwardly or downwardly through the support shaft 118 (see a solid line and a dash-and-dot line of FIG. 23B), thereby adjusting the gap between the second conveyor 4' and the reversing roller 80. In such a way, the height adjusting unit 15 can react to the case that thickness of tablets T is changed.

Also, a portion of the plate 117 has a plurality of through holes (not shown) formed thereinto and a chamber portion 120 is fitted to a portion of a bottom surface of the plate 117 to suction air from the through holes. The chamber portion 120 is coupled to a duct 119. Suctioning of air from the chamber portion 120 through the duct 119 causes tablets on the second conveyor 4' to be suction-held on the second conveyor 4'.

<Second Conveyor>

Figure 25:
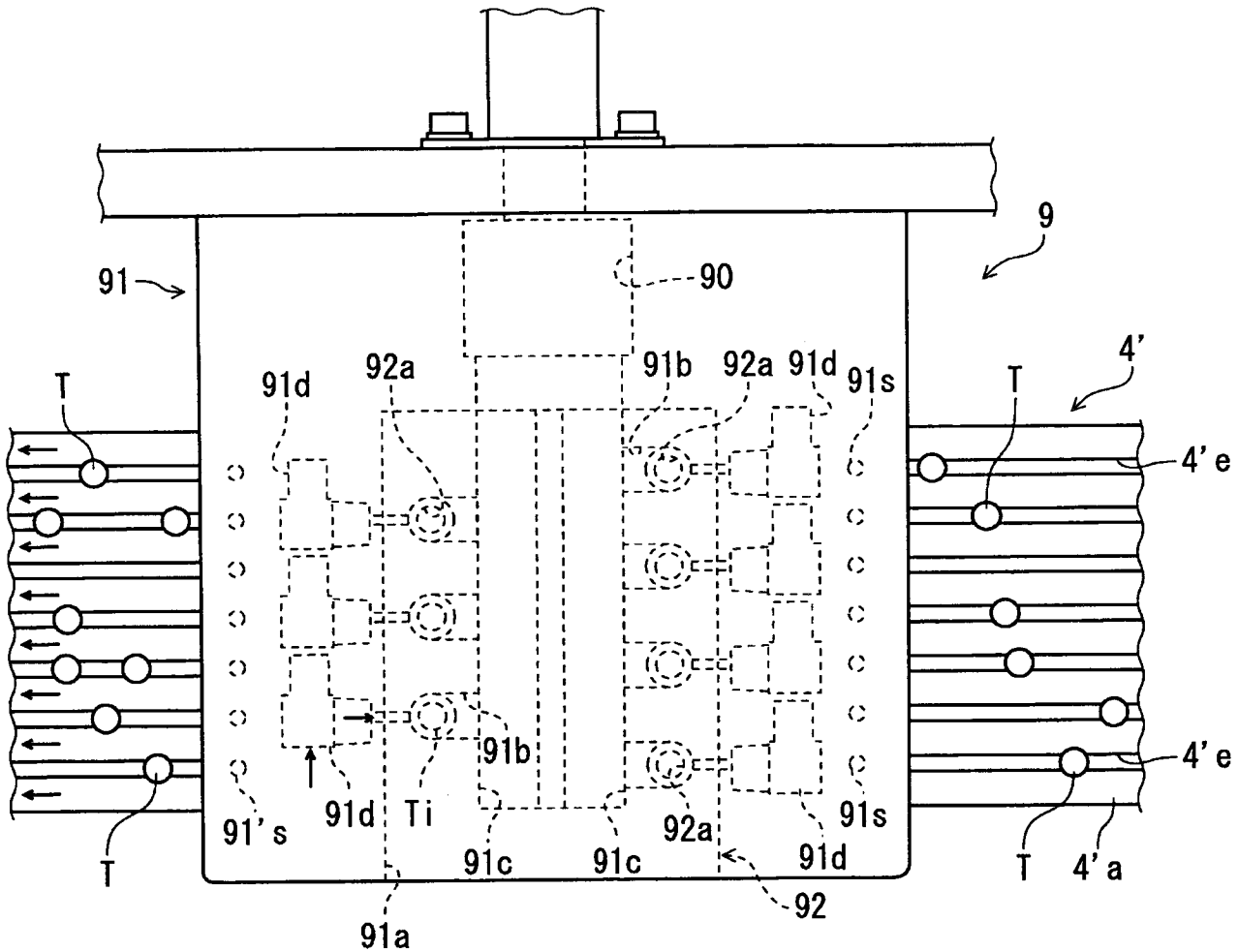
FIG. 25 is a schematic top plan view of a defective rejection unit constituting the tablet printing apparatus.

FIG. 25 shows a second conveyor. As shown in FIG. 25, the second conveyor 4' is formed of eight pieces of timing belts 4'*a* disposed side by side at a predetermined space 4'*e* in the lateral width direction perpendicular to the longitudinal conveyance direction (i.e. the left to right direction in FIG. 25), similarly to the first conveyor 4. Also, for R tablets, an R-shaped chamfer may be provided at a corner of each of the timing belts 4'*a* as with the first conveyor 4.

<Second Line Sensor Camera>

Figure 24:
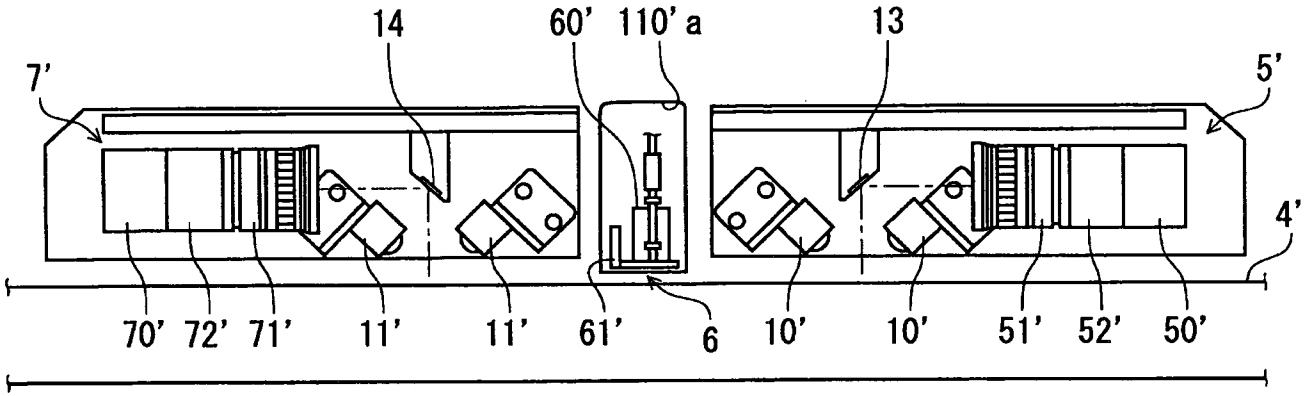
FIG. 24 is a schematic front elevational view of a second detection line sensor camera, a second inspection line sensor camera and a second inkjet printer that are disposed on a side of the second conveyor.

FIG. 24 shows a second detection line sensor camera and a second inspection line sensor camera. In the drawing, like reference numbers indicate identical or functionally similar elements.

The second detection line sensor camera 5' has a similar structure to the first detection line sensor camera 5 except that it is disposed sideways in a horizontal direction. As shown in FIG. 24, the second detection line sensor camera 5' includes a line sensor (CMOS sensor) 50' and a camera lens 51' fitted to the line sensor 50' via a lens mount 52'. The second detection line sensor camera 5' detects tablets on the second conveyor 4' through a mirror 13 disposed in front of the lens 51'. A shooting line of the second detection line sensor camera 5' extends in the lateral width direction of the second conveyor 4'.

Detection data of tablets T detected by the line sensor 50' of the second detection line sensor camera 5' includes types, positions, orientations, and heads or tails of the tablets T. The second detection line sensor camera 5' is synchronized with travel speed of the tablets T (i.e. conveyance speed of the second conveyor 4') in shooting.

The second inspection line sensor camera 7' has a similar structure to the first inspection line sensor camera 7 except that it is disposed sideways in the horizontal direction. As shown in FIG. 24, the second inspection line sensor camera 7' includes a line sensor (CMOS sensor) 70' and a camera lens 71' fitted to the line sensor 70' via a lens mount 72'. The second inspection line sensor camera 7' detects tablets on the second conveyor 4' through a mirror 14 disposed in front of the lens 71'. A shooting line of the second inspection line sensor camera 7' extends in the lateral width direction of the second conveyor 4'.

Detection data of tablets T detected by the line sensor 70' of the second inspection line sensor camera 7' includes information on print failure such as blur print, out-of-position print, and the like. The second inspection line sensor camera 7' is also synchronized with travel speed of the tablets T (i.e. conveyance speed of the second conveyor 4') in shooting.

Below the mirror 13, a pair of lighting units 10' are provided to cast light on the shooting line of the second detection line sensor camera 5'. Likewise, below the mirror 14, a pair of lighting units 11' are provided to cast light on the shooting line of the second inspection line sensor camera 7'.

In addition, each surface of the timing belts of the second conveyor 4' as well may be blackened to obtain a strong contrast against white tablets.

<Defective Rejection Unit>

FIGS. 25 to 28 show a defective rejection unit. As shown in these drawings, the defective rejection unit 9 includes a housing 91 disposed above the second conveyor 4' and a plate 92 adapted to be put in and taken out from the housing 91 through a front bottom portion thereof. At a bottom portion of the housing 91, there are provided a pair of guide rails 91*a* extending toward an inside of the housing 91 from the front bottom portion of the housing 91. The plate 92 is slidably supported on the guide rails 91*a*.

As shown in FIG. 25, the plate 92 is formed with a plurality of (here, seven) through holes 92*a* that extend vertically and that correspond to the rows of tablets T conveyed by the first and second conveyors 4, 4'. In this exemplification, four through holes 92*a* are formed on the upstream side of the second conveyor 4' and three through holes 92*a* on the downstream side of the second conveyor 4'. Each of the through holes 92*a* is disposed at a position above the corresponding space 4'*e* between the adjacent timing belts 4'*a* of the second conveyor 4'. A diameter of each of the through holes 92*a* is made slightly greater than a diameter of tablet T.

Figure 26:
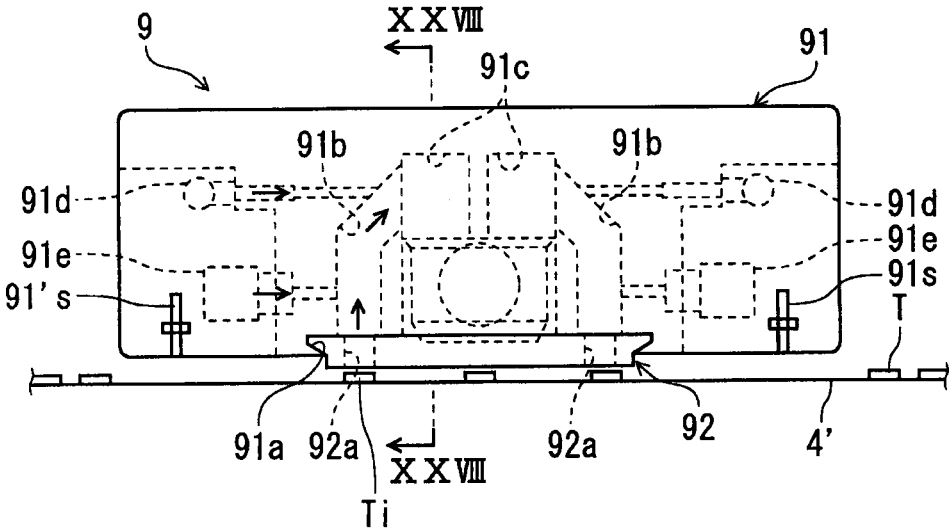
FIG. 26 is a schematic front elevational view of the defective rejection unit.
Figure 28:
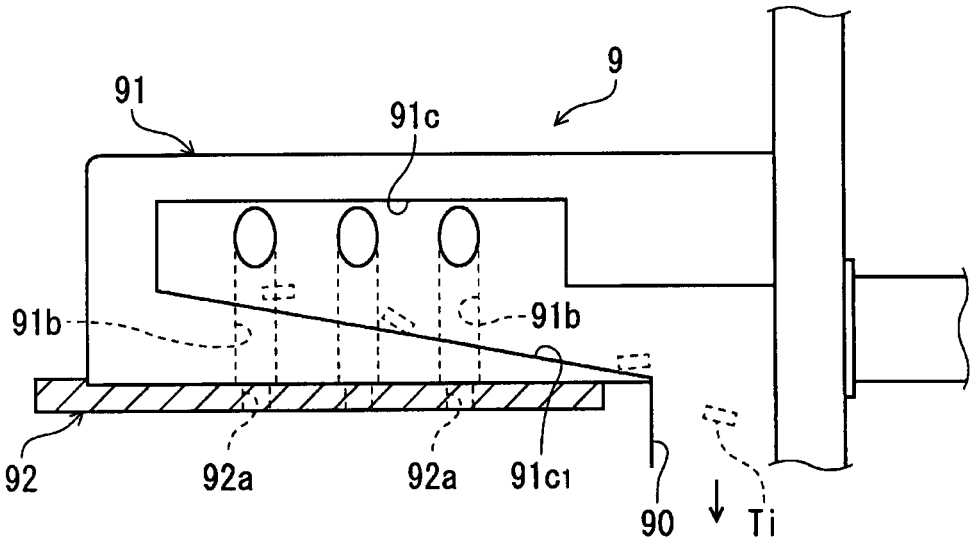
FIG. 28 is a cross sectional view of FIG. 26 taken along line XXVIII-XXVIII.

As shown in FIGS. 25 and 26, inside the housing 91, there are provided a plurality of (here, seven) passageways 91*b* that extend substantially upwardly and that correspond the through holes 92*a* of the plate 92, respectively. Each of lower ends of the passageways 91*b* opens at each of the through holes 92*a* of the plate 92 attached to the housing 91. Also, inside the housing 91, there are provided a pair of passageways 91*c* disposed side by side and extending in the lateral width direction of the second conveyor 4'. Each of upper ends of the passageways 91*b* opens at the passageways 91*c*. As shown in FIG. 28, the passageway 91*c* has a declined bottom surface 91$c_1$ that declines gradually downwardly as it progresses forward. A terminal of the passageway 91*c* is connected to the shoot 90 that leads to a defective discharge box (not shown).

As shown in FIGS. 25 and 26, the housing 91 has joints 91*d*, 91*e* connected to positions corresponding to the passageways 91*b*. Each of the joints 91*d*, 91*e* is connected to a pneumatic hose (not shown) that compressed air is introduced into. The joint 91*d* is adapted to introduce compressive air into an upper portion of the passageway 91*b* and the joint 91*e* is adapted to introduce compressive air into a lower portion of the passageway 91*b*.

Figure 27:
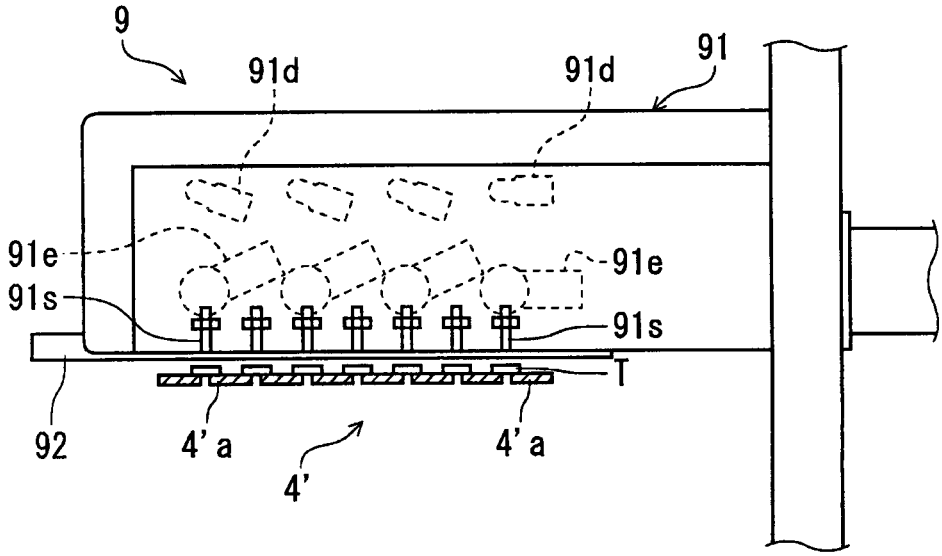
FIG. 27 is a side schematic view of the defective rejection unit.

As shown in FIG. 25, the housing 91 is provided with a plurality of (here, seven) sensors 91*s* along a side surface thereof on the upstream side of the second conveyor 4' (see FIG. 27). The housing 91 is also provided with a plurality of (here, seven) sensors 91's along a side surface thereof on the downstream side of the second conveyor 4' (see FIG. 26). The sensors 91*s* are adapted to detect positions of defectives and the sensors 91's to check rejection of the defectives. They are formed of for example, optical fiber sensors.

When a defective Ti detected by the sensor 91*s* has reached the position below a lower opening end of the passageway 91*b*, as compressive air is introduced into the passageway 91*b* from the joint 91*e*, the defective Ti is suctioned into the passageway 91*b* through the through hole 92*a* of the plate 92 due to negative pressure generated at the lower portion of the passageway 91*b*. The defective Ti suctioned into the passageway 91*b* is introduced into the passageway 91*c* from an upper opening end of the passageway 91*b* due to action of compressive air supplied to the passageway 91*b* from the joint 91*d*. Thereafter, the defective Ti passes along the declined surface 91$c_1$ of the passageway 91 and then is rejected into the defective discharge box thorough the shoot 90.

In such a manner, only defectives can be suctioned with pinpoint accuracy, thereby preventing non-defectives from being involved during rejection of defectives. In case a defective was not suction-held and yet to be rejected, such defective can be detected by the sensors 91*s*'. In this case, when the defective is discharged to the shoot 18 (FIG. 1) from the downstream end of the second conveyor 4', by opening the defective discharge damper 17, the defective will be discharged into the shoot 19 together with tablets in the vicinity of the defective.

Since the plate 92 is detachably provided relative to the housing 91, in the event that sizes, diameters, and thicknesses of tablets are changed, an operator has only to change the plate 92 into another plate that can correspond to tablets of different kinds.

<Controller>

Figure 29:
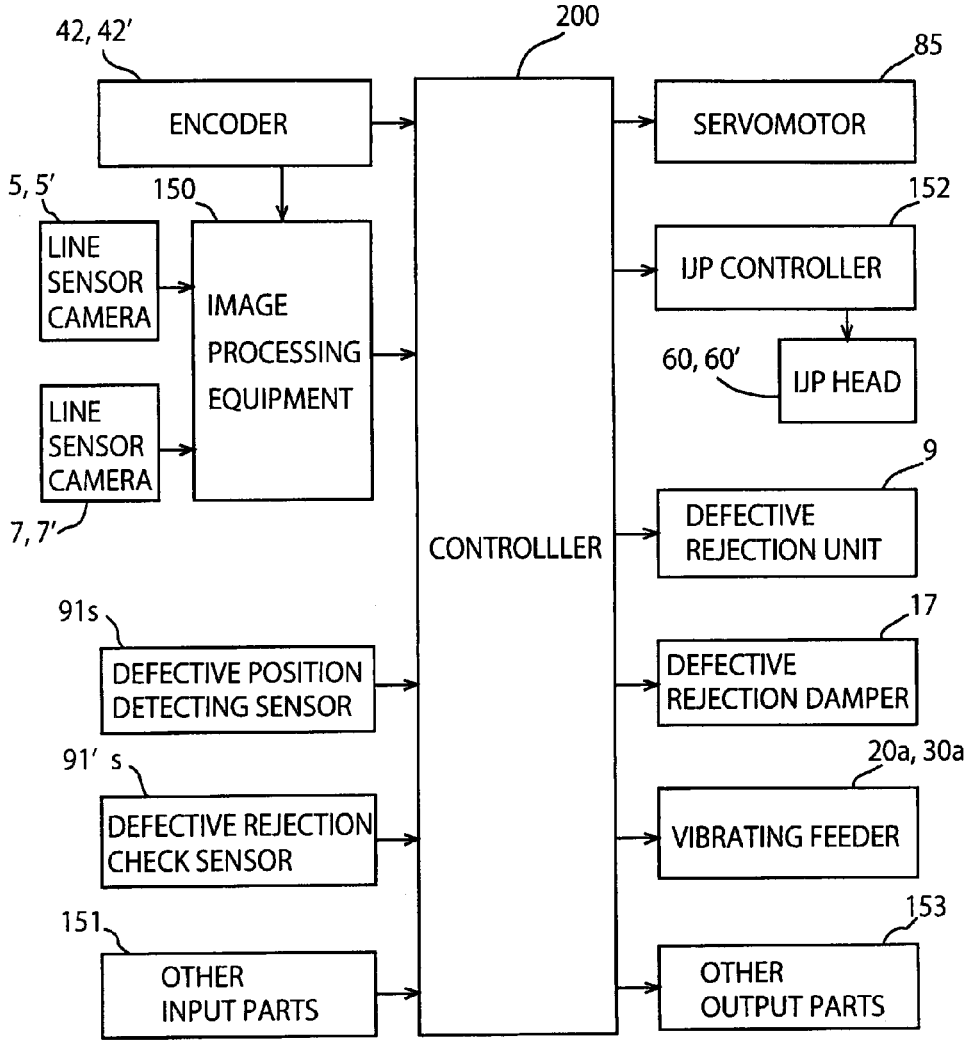
FIG. 29 is a block diagram of a controller of the tablet printing apparatus.

Then, a controller of the tablet printing apparatus 1 will be described in reference to FIG. 29. As shown in FIG. 29, with input ports of the controller 200 are connected the rotary encoders 42, 42' to detect travel positions of the first and second conveyors 4, 4', the first and second detection line sensor cameras 5, 5', the first and second inspection line censor cameras 7, 7', an image processing equipment 150 to create a print pattern based on data of tablets detected by the first and second detection line sensor cameras 5, 5', the defective position detecting sensors 91*s*, the defective rejection check sensors 91's, and other input parts 151 such as a keyboard.

With output ports of the controller 200 are connected the servomotor 85 to drive the first conveyor 4 and a servomotor to drive the second conveyor 4', the first and second inkjet (IJP) heads 60, 60, an IJP controller 152 to drive the IJP heads 60, 60', the defective rejection unit 9, the defective rejection damper 17, the vibrating feeder 20*a*, 33, and other output parts 153 such as a monitor.

<Processes of Detection, Printing and Inspection of Tablets>

Figure 31:
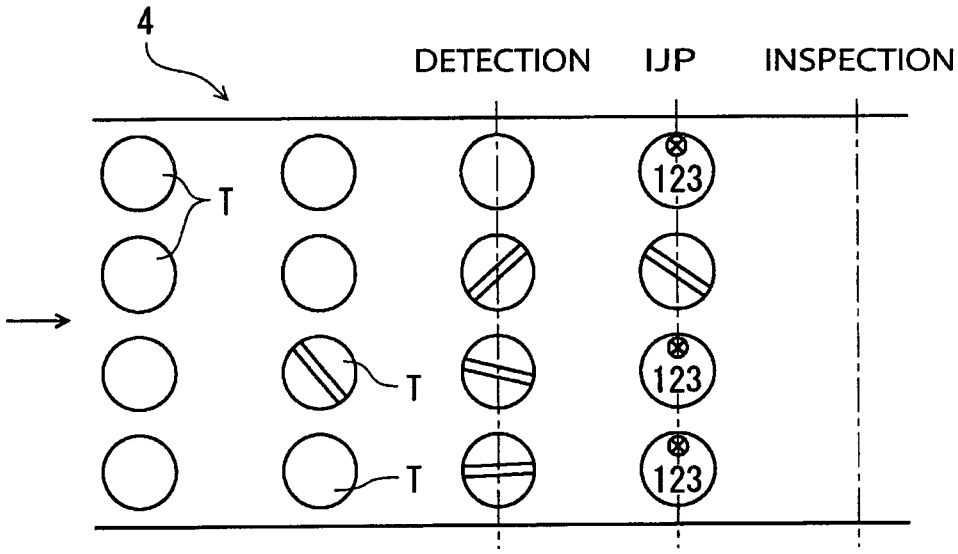
FIG. 31 is a top plan view illustrating a detection process for detecting tablets on the first conveyor and a printing process for printing on the tablets on the first conveyor.
Figure 32:
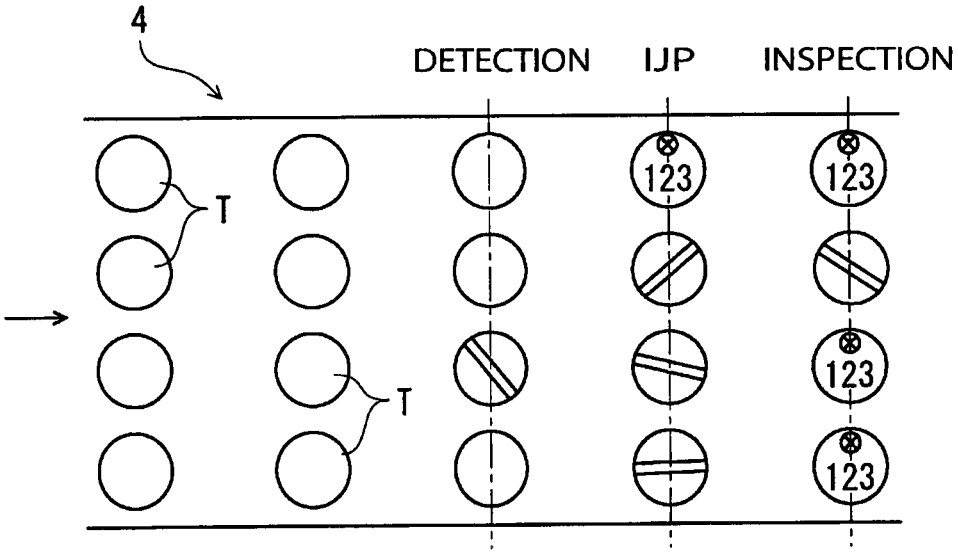
FIG. 32 is a top plan view illustrating a detection process for detecting tablets on the first conveyor, a printing process for printing on the tablets on the first conveyor, and an inspection process for inspecting the tablets on the first conveyor.
Figure 33:
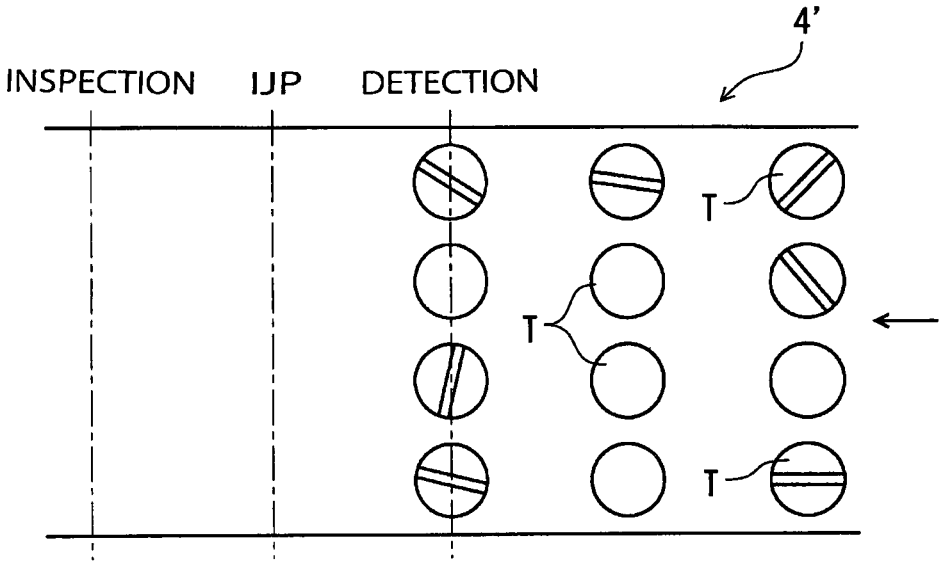
FIG. 33 is a top plan view illustrating a detection process for detecting tablets on the second conveyor.
Figure 34:
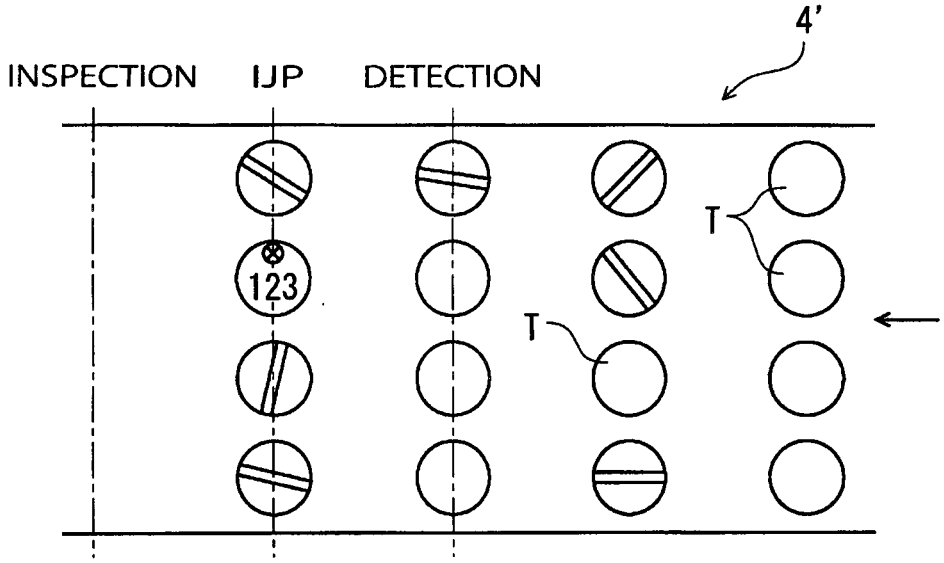
FIG. 34 is a top plan view illustrating a detection process for detecting tablets on the second conveyor and a printing process for printing on the tablets on the second conveyor.
Figure 35:
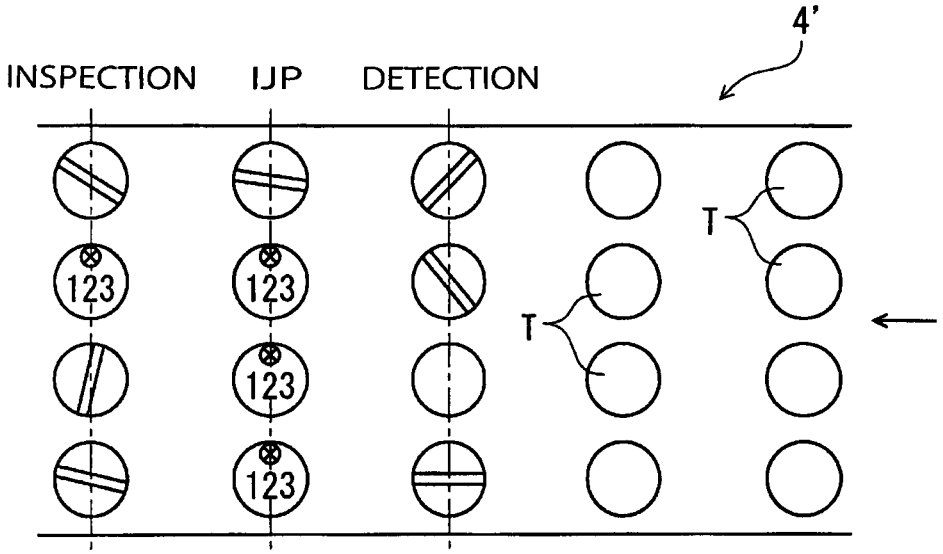
FIG. 35 is a top plan view illustrating a detection process for detecting tablets on the second conveyor, a printing process for printing on the tablets on the second conveyor, and an inspection process for inspecting the tablets on the second conveyor.

Then, processes of detection, printing and inspection of tablets T on the first and second conveyors 4, 4' will be explained in reference to FIGS. 30 to 35. In these drawings, FIGS. 30 to 32 illustrate the processes of the tablets T on the first conveyors 4 and FIGS. 33 to 35 illustrate the processes of the tablets T on the second conveyors 4'.

For illustration purposes, the drawings indicate the state that the tablets T on the first and second conveyors 4, 4' are aligned in the lateral width direction perpendicular to the longitudinal conveyance direction of the first and second conveyors 4, 4'. In actual operation, the tablets T on the first and second conveyors 4, 4' are not aligned in the lateral width direction but randomly disposed in the lateral width direction. However, in this case as well, the tablets T are spaced equally in the lateral width direction perpendicular to the longitudinal conveyance direction of the first and second conveyors 4, 4'. That is, spacing of laterally adjacent tablets T on the first and second conveyors 4, 4' is equal. Also, for illustration purposes, the drawings indicate the state that the tablets T line up in fours not sevens in the lateral width direction. In the illustrated embodiments, tablet T having a secant line formed on one of the surfaces thereof is shown and a printing process is exemplified such that printing is conducted only on a surface of tablet T without a secant line.

Also, in the drawings, a dash-and-dot line designated by "DETECTION" indicates a detection position of the first and second detection line sensor cameras 5, 5', a dash-and-dot line designated by "IJP" indicates a print position of the first inkjet printer 6, 6', and a dash-and-dot line designated by "INSPECTION" indicates an inspection position of the first and second inspection line sensor cameras 7, 7'.

Figure 30:
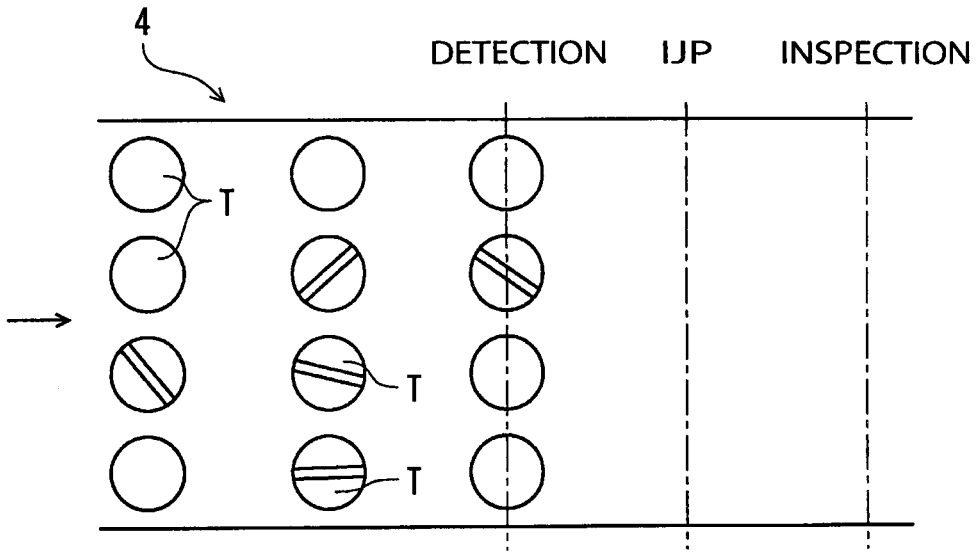
FIG. 30 is a top plan view illustrating a detection process for detecting tablets on the first conveyor.

A large number of tablets T that have been supplied by the hopper 2 (FIG. 1) and that have been distributed in a predetermined plurality of rows by the distribution unit 3 (FIG. 1), are conveyed randomly (see FIG. 13) in an arrow marked direction (or a first conveyance direction) of FIG. 30 with the plurality of rows maintained by the first conveyor 4. At this juncture, faces of the tablets T and orientations of the secant lines of the tablets T are irregular or inconsistent, but as above-mentioned, spacing of the laterally adjacent tablets T is equal.

At the detection position shown in FIG. 30, the tablets T are detected by the first detection line sensor camera 5. Then, each of the tablets T is photographed through the camera lens 51 of the first detection line sensor camera 5 and image data of each of the tablets T is detected by the line sensor 50. Data of the tablets T detected by the line sensor 50 include information on tablets T such as types, positions, orientations, and heads or tails of the tablets T, photographing or image capturing by the first detection line sensor camera 5 is conducted in synchronism with a transfer speed of the tablets T (i.e. conveyance speed of the first conveyor 4).

The tablets T that have been detected by the first detection line sensor camera 5, as shown in FIG. 31, are subject to print process at the print (IJP) position by the first inkjet printer 6. Then, the first inkjet printer 6 prints on the tablets T during conveyance based on data of the tablets T detected by the first detection line sensor camera 5. In the illustrated embodiment, print process is conducted only on the face without a secant line of each of the tablets T, not on the face with a secant line. Also, at the time of print process, print timing of the first inkjet printer 6 is synchronized with a transfer speed of the tablets T (i.e. conveyance speed of the first conveyor 4). Thereby, printing on tablets T during conveyance can be conducted precisely.

Print patterns of the first inkjet printer 6 include a "company mark" consisting of symbols and a "tablet code" consisting of numbers shown in FIG. 31, also including a "shortened company code", an "expiration date", a "manufacturing number", a "principal agent content", a "QR code", a "barcode", and so on. In these print patterns, "tablet code", "principal agent content", "QR code", and "barcode" change according to kinds of drugs, and "expiration date" and "manufacturing number" change even in drugs of the same kinds. However, in this embodiment, use of computers facilitates change of print patterns. Also, in this embodiment, since contactless printing is conducted by a contactless printer such as an inkjet printer, printing can be applied to tablets of any dosage form including uncoated tablets, film-coated tablets, and sugar-coated tablets, and also applied to tablets of any shapes including flat tablets and R tablets. In either case, clear print is available.

Tablets T that have been subject to print process of the first inkjet printer 6, as shown in FIG. 32, are examined by the first inspection line sensor camera 7 at the inspection position. Then, print state of each of the tablets T is photographed through the camera lens 71 of the first inspection line sensor camera 7 and an image data of each of the tablets T is detected by the line sensor 70. Data of the tablets T detected by the line sensor 70 include information on tablets relating to printing failure such as blurred print, out-of-position print and the like. Also, photographing or image capturing by the first inspection line sensor camera 7 is conducted in synchronism with a transfer speed of the tablets T (i.e. conveyance speed of the first conveyor 4).

The above-mentioned detection, printing and inspection processes of the tablets T are carried out successively during conveyance of the tablets T by the first conveyor 4. That is, as shown in FIG. 32, while the tablets T on the downstream side in the longitudinal conveyance direction are subject to the inspection process at the inspection position, the tablets on the upstream side of the inspection position are subject to the printing process at the printing (IJP) position. Also, at this juncture, the tablets on the upstream side of the printing position are subject to the detection process at the detection position.

The tablets T, which have been subject to the detection, printing and inspection processes on the first conveyor 4 in the above-mentioned manner, are reversed by the reversing unit 8 (FIG. 1) and transferred to the second conveyor 4'. The tablets T transferred to the second conveyor 4' are conveyed in an arrow marked direction (second conveyance direction) randomly with the plurality of rows maintained by the second conveyor 4', as shown in FIG. 33. Then, faces of the tablets T are reversed, that is, the front and back surfaces of the tablets T on the second conveyor 4' are opposite the front and back surfaces of the tablets T on the first conveyor 4. Also, in this case as well, spacing between the tablets T in the lateral width direction perpendicular to the longitudinal conveyance direction on the second conveyor 4' is equal.

At the detection position shown in FIG. 33, the tablets T are detected by the second detection line sensor camera 5'. Then, each of the tablets T is photographed through the camera lens 51' of second detection line sensor camera 5' and image data of each of the tablets T is detected by the line sensor 50'. Data of the tablets T detected by the line sensor 50' include information on the tablets T such as positions, orientations, and heads or tails of the tablets T, photographing or image capturing by the second detection line sensor camera 5' is conducted in synchronism with a transfer speed of the tablets T (i.e. conveyance speed of the second conveyor 4').

The tablets T that have been detected by the second detection line sensor camera 5', as shown in FIG. 34, are subject to print process at the print (IJP) position by the second inkjet printer 6'. Then, the second inkjet printer 6' prints on the tablets T during conveyance based on data of the tablets T detected by the second detection line sensor camera 5'. In the illustrated embodiment, print process is carried out only on the face without a secant line of each of the tablets T, not on the face with a secant line. Also, at the time of print process, print timing of the second inkjet printer 6' is synchronized with a transfer speed of the tablets T (i.e. conveyance speed of the second conveyor 4'). Thereby, printing on tablets T during conveyance can be conducted precisely.

Print patterns of the second inkjet printer 6', as with the print process on the first conveyor 4, include not only "company mark" and "tablet code", but also "shortened company code", "expiration date", "manufacturing number", "principal agent content", "QR code", "barcode", and so on, as shown in FIG. 34. Also, in this case, since contactless printing is conducted by a contactless printer such as an inkjet printer, change of print patterns can be made easily, printing can be applied to tablets of any dosage form and shapes, and clear print is available.

Tablets T that have been subject to print process of the second inkjet printer 6', as shown in FIG. 35, are examined by the second inspection line sensor camera 7' at the inspection position. Then, print state of each of the tablets T is photographed through the camera lens 71' of the second inspection line sensor camera 7' and image data of each of the tablets T is detected by the line sensor 70'. Data of the tablets T detected by the line sensor 70' include information on tablets relating to printing failure such as blurred print, out-of-position print and the like. Also, photographing or image capturing by the second inspection line sensor camera 7' is conducted in synchronism with a transfer speed of the tablets T (i.e. conveyance speed of the second conveyor 4').

The above-mentioned detection, printing and inspection processes of the tablets T are carried out successively during conveyance of the tablets T by the second conveyor 4'. That is, as shown in FIG. 35, while the tablets T on the downstream side in the longitudinal conveyance direction are subject to the inspection process at the inspection position, the tablets on the upstream side of the inspection position are subject to the printing process at the printing (IJP) position. Also, at this juncture, the tablets on the upstream side of the printing position are subject to the detection process at the detection position.

In the examples shown in FIGS. 30 to 35, tablet T with a secant line is shown and print process is carried out only on the surface without the secant line. However, since data of the tablets T detected by the first and second detection line sensor cameras 5, 5' include not only positions of the tablets T but also orientations of the tablets T, print process may be carried out on the surface with the secant line in accordance with a direction of the secant line.

<Defective Rejection Process>

Figure 36:
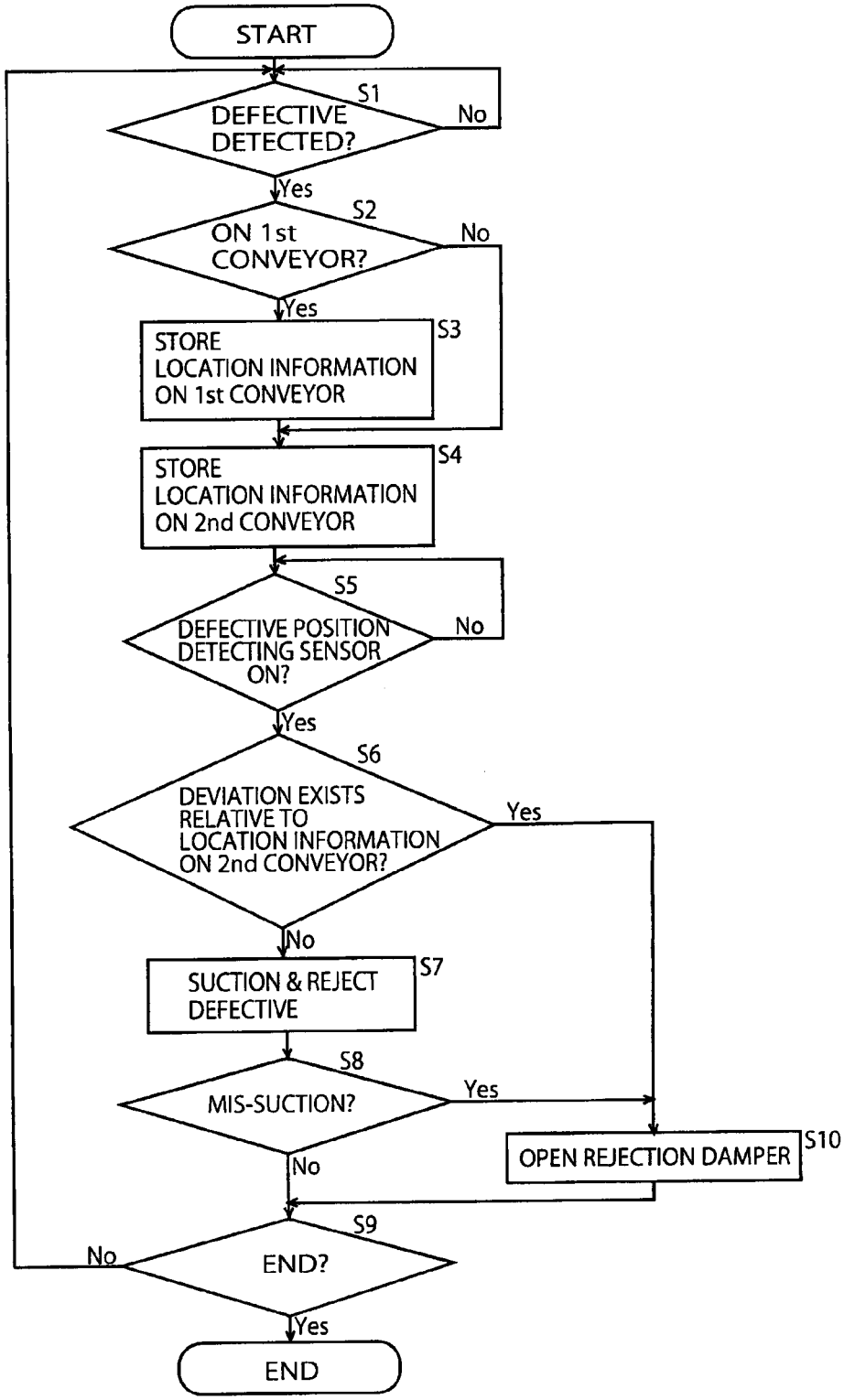
FIG. 36 is a flow diagram showing a defective rejection control conducted by the controller.

Then, we will explain the defective rejection process in the event that a defective such as printing failure is detected by the first and second inspection line sensor cameras 7, 7' in reference to a flow diagram of FIG. 36.

First, at Step S1 of FIG. 36, a program waits till a defective is detected. When a defective is detected the program moves onto Step S2. At Step S2, the program judges whether the defective is detected on the first conveyor 4, that is, the first inspection line sensor camera 7 detects the defective or not.

If the defective is detected on the first conveyor 4, the program moves onto Step S3. At Step S3, positional information of the defective is stored as positional information on the first conveyor 4. Positional information of each of the tablets T on the first conveyor 4 is created by obtaining positional information of travel of the first conveyor 4 successively through the rotary encoder 42 based on data detected by the first detection line sensor camera 5. Positional information of the defective is also created similarly.

After process of Step S3, the program moves onto Step S4. At Step S4, positional information stored at Step S3 is stored as positional information on the second conveyor 4'. The reason why such a process is required is that the tablets T on the first conveyor 4 are reversed by the reversing unit 8 and thereafter transferred to and conveyed by the second conveyor 4'.

Then at Step S5, the program waits till the defective position detection sensor 91*s* of the defective rejection unit 9 turns on. When the sensor 91*s* turns on, the program moves onto Step S6. At Step S6, the program judges whether deviation exists between positional data detected by the sensor 91*s* and positional information on the second conveyor 4'.

If there is no deviation, the program is transferred from Step S6 to Step S7. At Step S7, suction and rejection process of the defective is carried out. In this case, as shown in FIGS. 25 and 26, when the defective Ti travels to the position of the corresponding through hole 92*a* of the plate 92, compressive air is introduced into the corresponding passageway 91*b* from the corresponding joint 91*e*. Then, as the lower portion of the passageway 91*b* becomes a negative-pressure state, the defective Ti is suctioned into the passageway 91*b* through the through holes 92*a*. The defective Ti suctioned into the passageway 91*b* enters the passageway 91*c* from the upper opening of the passageway 91*b* due to action of compressive air introduced into the passageway 91*b* from the joint 91*d*, and passing along the declined surface 91$c_1$ of the passageway 91, the defective Ti is rejected into the defective box through the shoot 90. In such a way, only defectives can be suctioned with pinpoint accuracy, thereby preventing non-defectives from being involved during rejection of defectives.

Then, at Step S8, the program judges whether mis-suction was involved during the suction and rejection process at Step S7. This judgment is carried out whether the defective rejection check sensor 91's of the defective rejection unit 9 has sensed the defective or not. If there was mis-suction of a defective, the defective Ti that was not suctioned is sensed by the defective rejection check sensor 91's. If there was no mis-suction, the program goes onto Step S9.

At Step S9, the program judges whether it should terminate the process or not. If judgment of Step S9 is "yes", then the program terminates. If judgment of Step S9 is "no", then the program moves back to Step S1 and executes Steps S1 to S8 repeatedly.

On the other hand, at Step S2, if the defective is detected not on the first conveyor 4 but on the second conveyor 4', that is, if the second detection line sensor camera 5' has detected the defective, then the program moves to Step S4 and executes the processes of Steps S4 to S9.

At Step S6, if there existed deviation relative to positional information on the second conveyor 4', then the program moves to Step S10. Also, at Step S8, if there was mis-suction, then the program moves to Step S10.

At Step S10, when the defective Ti is rejected into the shoot 18 from the downstream end of the second conveyor 4', the rejection damper 17 is driven to open such that the defective Ti together with tablets in the vicinity of the defective T is rejected into the shoot 19. In such a manner, the defective Ti can be securely rejected.

According to the present embodiment, since the first and second inkjet printers print on a large number of tablets conveyed by the first and second conveyors, contactless-printing on the tablets can be achieved. Also, since print process is successively carried out based on data of the tablets detected by the first and second detection line sensor cameras, it can also react to tablets of random positions, orientations and the like with ease. Moreover, since the first and second conveyors convey tablets with a plurality of rows of tablets maintained, spacing of the tablets is random in the longitudinal conveyance direction but equal in the lateral width direction perpendicular to the longitudinal conveyance direction. Thereby, when rejecting a defective, the defective can be easily separated from other tablets adjacent to the defective in the lateral width direction. As a result of this, only the defective can be rejected with pinpoint accuracy.

Figure 37A:
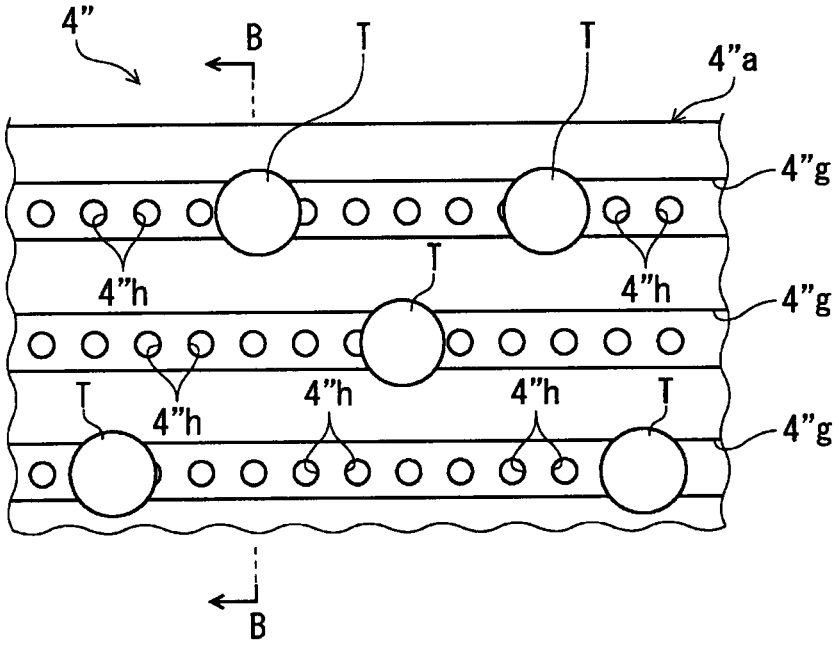
FIG. 37A is a top plan view of a portion of an alternative embodiment of the conveyor.
Figure 37B:
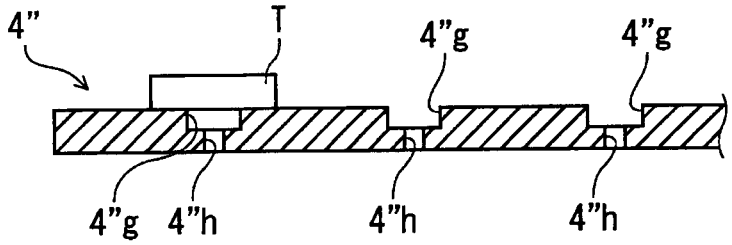
FIG. 37B is a cross sectional view of FIG. 37A taken along line B-B.

In the above-mentioned embodiment, the conveyor was composed of a plurality of belts disposed side by side and spaced at a substantially equal distance, but application of the present invention is not limited to such an example. FIGS. 37A and 37B show a variant of the conveyor. In the drawings, like reference numbers indicate identical or functionally similar elements.

As shown in FIG. 37A, a top plan view, and FIG. 37B, a cross sectional view of FIG. 37A taken along line B-B, a conveyor 4" is composed of a single timing belt 4"*a*. The timing belt 4"*a* is a relatively wide belt in the lateral width direction (i.e. the up-and-down direction in FIG. 37A) perpendicular to the longitudinal conveyance direction (i.e. the left to right direction in FIG. 37A). The timing belt 4"*a* has a plurality of grooves 4"*g* formed on a top surface thereof and extending along the longitudinal conveyance direction. The number of grooves 4"*g* corresponds to the number of rows of tablets T conveyed by the conveyer 4". Each of the grooves 4"*g* is formed with a plurality of suction holes 4"*h* that pass through the timing belt 4"*a* in a vertical direction and that are spaced at a predetermined spacing along the length of the groove 4"*g*.

In this case, by suctioning air from the suction holes 4"*h*, the tablets T are suction-held at the suction holes 4"*h* of the corresponding grooves 4"*g* of the timing belt 4"*a* during conveyance.

In the above-mentioned embodiment, the reversing roller was provided to reverse the faces of the tablets to print on the front-side face without the secant line and the backside face without the secant line of the tablets and there were also provided a second detection line sensor camera, a second inkjet printer, and a second inspection line sensor camera on the side of second conveyor, but the present invention has also an application in which print process is carried out only on the front-side face of the tablet. In this case, the defective rejection unit 9 is provided on the downstream side of the first conveyor 4.

In the above-mentioned embodiment, line sensor cameras were used as image capturing means of tablets, but in the present invention, other cameras may be used if only they have image elements. For example, area sensor cameras can also be used.

In the above-mentioned embodiment, an inkjet printer was shown as a preferable example of the printer, but an application of the present invention is not limited to the inkjet printer so long as the printer can print on tablets contactlessly. For example, a laser printer may be used that is not suitable for printing on a tablet such as an uncoated tablet but suitable for printing on a tablet such as a film-coated tablet or a sugar-coated tablet including titanium oxide on a surface thereof. In the alternative, other printers may also be used.

INDUSTRIAL APPLICABILITY

A tablet printing apparatus according to the present invention is useful for an apparatus that contactless-prints on a large number of tablets supplied successively and randomly in a predetermined plurality of rows of tablets, and it is especially suited to an apparatus that rejects only a defective tablet securely with pinpoint accuracy.

The invention claimed is:

1. A tablet printing apparatus for printing on tablets comprising:

a tablet supplying unit configured to supply tablets;

a distributing unit configured to distribute supplied tablets in a predetermined plurality of rows;

a tablet conveying unit configured to convey distributed tablets along plural conveyance paths corresponding to the plurality of rows and extending in a conveyance direction, whereby the tablets are suction-held on at least a portion of each respective conveyance path and the tablets are conveyed randomly in the conveyance direction;

a tablet detecting unit configured to detect the tablets during conveyance by said tablet conveying unit whereby the tablet detecting unit detects positions and orientations of the tablets and detects a heads or tails state of two opposite sides of the tablets and produces corresponding data;

a contactless-printing unit to print on the tablets contactlessly during conveyance by said tablet conveying unit based on data produced by said tablet detecting unit;

a tablet inspection unit to check a printing state on the tablets; and a defective rejection unit to reject a defective tablet during conveyance of the tablets in the plurality of rows, said defective tablet being determined to include a printing failure based on a check result of said tablet inspection unit.

2. The tablet printing apparatus according to claim 1, wherein said distributing unit includes a central dispersion part having an inverted V-shape in cross section and located centrally in a width direction of said distributing unit, and a plurality of distributing parts each having an inverted V-shape in cross section and located on opposite sides of said central dispersion part, said central dispersion part having a pair of inclined surfaces extending in a direction of conveyance of the tablets to disperse the tablets on opposite sides of said central dispersion part, each of said distributing parts having a pair of inclined surfaces of an asymmetrical shape extending in the direction of conveyance of the tablets to distribute the tablets in the plurality of rows, said inclined surfaces of each of said distributing parts being formed of a first inclined surface located at a position close to said central dispersion part and extending upright, and a second inclined surface located away from said central dispersion part and extending diagonally.

3. The tablet printing apparatus according to claim 2, wherein respective heights of said first and second inclined surfaces of said plurality of distributing parts become gradually greater from a side closer to said central dispersion part as said first and second inclined surfaces progress downstream along the direction of conveyance of said tablet conveying unit.

4. The tablet printing apparatus according to claim 1, wherein said tablet conveying unit comprises a plurality of conveying parts, the tablets being suction-held on said corresponding conveying parts during conveyance.

5. The tablet printing apparatus according to claim 4, wherein said plurality of conveying parts comprise a plurality of belts that are spaced side by side, the tablets during conveyance being suction-held at spaces between adjacent said belts.

6. The tablet printing apparatus according to claim 4, wherein said plurality of conveying parts have a plurality of rows of suction holes on said conveying parts, the tablets during conveyance being suction-held at said corresponding row of suction holes.

7. The tablet printing apparatus according to claim 1, wherein said tablet detecting unit and said tablet inspection unit respectively comprise image capturing devices.

8. The tablet printing apparatus according to claim 1, wherein the data used by said contactless-printing unit includes said positions and said orientations of the tablets.

9. The tablet printing apparatus according to claim 8, wherein the data used by said contactless-printing unit further includes said heads or tails state of said two opposite sides of the tablets.

10. The tablet printing apparatus according to claim 1, wherein said contactless-printing unit comprises an inkjet printer including a translatable inkjet head.

11. The tablet printing apparatus according to claim 10, wherein said inkjet head includes a plurality of nozzles for discharging ink, and wherein before starting a new print process said inkjet head is controlled so that selected ones of the nozzles different from prior ones of the nozzles used in a prior print process are used for the new print process.

12. The tablet printing apparatus according to claim 1, wherein said defective rejection unit is disposed above said tablet conveying unit and has a plurality of apertures respectively corresponding to each of said rows of the tablets conveyed by said tablet conveying unit, said defective tablet being rejected from said corresponding aperture.

13. The tablet printing apparatus according to claim 12, wherein said defective rejection unit suctions said defective tablet from said aperture.

14. The tablet printing apparatus according to claim 1, wherein said tablet conveying unit comprises a first conveying unit that is disposed on an upper side of said tablet conveying unit and that conveys the tablets in a first direction, and a second conveying unit that is disposed below said first conveying unit and that conveys the tablets in a second direction opposite said first direction, and said apparatus further comprises a reversing unit between a downstream end of said first conveying unit and an upstream end of said second conveying unit for reversing a front side and a back side of each of the tablets by holding and rotating the tablets on said first conveying unit.

15. The tablet printing apparatus according to claim 14, wherein said reversing unit suctions the tablets during reverse of the tablets and releases the tablets after reverse of the tablets such that the tablets on said first conveying unit are reversed with respect to the front side and the back side thereof, and are delivered to said second conveying unit.

16. The tablet printing apparatus according to claim 14, wherein there is a gap between said reversing unit and said second conveying unit, said gap being adjustable.

17. The tablet printing apparatus according to claim 14 further comprising:

a second tablet detecting unit to detect the tablets during conveyance by said second conveying unit;

a second contactless-printing unit to print on the tablets during conveyance by said second conveying unit based on data detected by said second tablet detecting unit; and a second tablet inspection unit to check a printing state on the tablets printed by said second contactless-printing unit, wherein said defective rejection unit is disposed on a downstream side of said second tablet inspection unit, said defective rejection unit being so constructed as to reject the defective tablet which was determined to include a printing failure based on the check result of said first tablet inspection unit and a check result of said second tablet inspection unit.

18. A method for printing on tablets comprising:

a distributing process for distributing tablets in a predetermined plurality of rows;

a conveying process for conveying the tablets along plural conveyance paths corresponding to the predetermined plurality of rows and extending in a conveyance direction, whereby the tablets are suction-held on at least a portion of each respective conveyance path and the tablets are conveyed randomly in the conveyance direction;

a detecting process for detecting the tablets during conveyance in said conveying process, including detecting positions and orientations of the tablets and detecting a heads or tails state of two opposite sides of the tablets;

a printing process for contactless-printing on the tablets during conveyance in said conveying process based on data detected in said detecting process;

an inspection process for checking a printing state on the tablets; and a rejection process for rejecting a defective tablet during conveyance of the tablets in the plurality of rows of the tablets, said defective tablet being determined to include a printing failure based on a check result in said inspection process.

19. The method according to claim 18, further comprising producing detection data in said detecting process, wherein said detection data includes said positions and said orientations of the tablets.

20. A method of printing on tablets, comprising steps:

a) feeding and distributing tablets into plural rows of said tablets onto a conveyor apparatus, so that said rows have a fixed lateral spacing therebetween, and in each one of said rows there are random longitudinal spacing intervals between successive ones of said tablets in a longitudinal conveyance direction of said conveyor apparatus;

b) using said conveyor apparatus, conveying said tablets in said longitudinal conveyance direction while maintaining said random longitudinal spacing intervals between said successive tablets in said longitudinal conveyance direction and maintaining said rows of said tablets with said fixed lateral spacing therebetween;

c) using a sensor device, detecting at least one feature of said tablets during said conveying, and producing corresponding detection data; and d) using a contactless printing device, printing in a contactless manner on said tablets dependent on said detection data during said conveying.

* * * * *